US007971400B2

(12) United States Patent
Boldt et al.

(10) Patent No.: US 7,971,400 B2
(45) Date of Patent: Jul. 5, 2011

(54) DOOR FRAMES AND COVERINGS

(75) Inventors: Gary L. Boldt, Green Bay, WI (US); Todd Noskowiak, Green Bay, WI (US); Todd A. Carlson, DePere, WI (US)

(73) Assignee: Bay Industries, Inc., Green Bay, WI (US)

( * ) Notice: Subject to any disclaimer, the term of this patent is extended or adjusted under 35 U.S.C. 154(b) by 431 days.

(21) Appl. No.: 12/008,464

(22) Filed: Jan. 10, 2008

(65) Prior Publication Data

US 2008/0172956 A1 Jul. 24, 2008

Related U.S. Application Data

(60) Provisional application No. 60/885,121, filed on Jan. 16, 2007.

(51) Int. Cl.
*E06B 1/04* (2006.01)

(52) U.S. Cl. ..... 52/204.1; 52/656.2; 52/656.4

(58) Field of Classification Search ..... 52/204.1, 52/656.4, 656.2; 49/504
See application file for complete search history.

(56) References Cited

U.S. PATENT DOCUMENTS

| | | | |
|---|---|---|---|
| 2,755,895 | A | 7/1956 | Walterman et al. |
| 2,854,843 | A | 10/1958 | Lamb |
| 3,103,263 | A | 9/1963 | Leeser |
| 3,591,985 | A | 7/1971 | Coppins |
| 3,609,928 | A | 10/1971 | Mock |
| 3,690,082 | A | 9/1972 | Byland |
| 3,769,773 | A | 11/1973 | Mochizuki |
| 3,774,345 | A | 11/1973 | Cole et al. |
| 3,783,559 | A | 1/1974 | Yocum et al. |
| 3,808,759 | A | 5/1974 | Carmichael |
| 3,812,621 | A | 5/1974 | Ragland |
| 4,090,799 | A | 5/1978 | Crotti et al. |
| 4,236,354 | A | 12/1980 | Passovoy |
| 4,306,821 | A | 12/1981 | Moore |

(Continued)

FOREIGN PATENT DOCUMENTS

EP 0 466 292 1/1992

OTHER PUBLICATIONS

Framesaver, Put an end to rot damaged door frames., Undated, 1 Page.

(Continued)

*Primary Examiner* — Brian E Glessner
*Assistant Examiner* — Beth Stephan
(74) *Attorney, Agent, or Firm* — Thomas D. Wilhelm; Wilhelm Law, S.C.

(57) ABSTRACT

Door frames, frame kits, component parts, jamb coverings, and depth extenders, all constructed with fiber reinforced pultruded structures, for entrance doors to buildings, both garage entrance doors and personnel entry doors. Some embodiments have a closed back wall. Others have an open cavity at the back wall to receive a reinforcing substrate. Some embodiments include a pultruded nosing block. Some embodiments comprise a pultruded depth extender, mountable on a jamb base to extend the depth of a door jamb. A mounting finger and a locking stud on the depth extender are mountable in cavities in the jamb base. A depth extender can be used to extend the depth of either a garage door frame or a personnel entry door frame. In an in-swing door frame, a door latch-side abutment surface is located on the side wall of the jamb base.

23 Claims, 11 Drawing Sheets

U.S. PATENT DOCUMENTS

| | | | | | |
|---|---|---|---|---|---|
| 4,308,692 | A | | 1/1982 | Rumble et al. | |
| 4,505,080 | A | | 3/1985 | Sailor | |
| 4,509,294 | A | | 4/1985 | Boilard | |
| 4,531,337 | A | | 7/1985 | Holdiman | |
| 4,644,722 | A | | 2/1987 | Phillips | |
| 4,702,057 | A | | 10/1987 | Phillips | |
| 4,821,472 | A | | 4/1989 | Tix | |
| 4,892,601 | A | | 1/1990 | Norwood | |
| 4,999,957 | A | | 3/1991 | Kessler | |
| 5,070,651 | A | | 12/1991 | Jeter | |
| 5,119,609 | A | | 6/1992 | Tait et al. | |
| 5,175,973 | A | | 1/1993 | Owen et al. | |
| 5,293,723 | A | * | 3/1994 | Slessor | 52/213 |
| 5,365,708 | A | | 11/1994 | Winston | |
| 5,375,383 | A | | 12/1994 | Lin et al. | |
| 5,380,131 | A | | 1/1995 | Crawford | |
| 5,437,130 | A | | 8/1995 | Raynak | |
| 5,546,715 | A | | 8/1996 | Edstrom | |
| 5,553,438 | A | | 9/1996 | Hsu | |
| 5,572,840 | A | | 11/1996 | Fast et al. | |
| 5,573,354 | A | | 11/1996 | Koch | |
| 5,590,496 | A | | 1/1997 | Martin et al. | |
| 5,603,191 | A | * | 2/1997 | Wu | 52/204.1 |
| 5,619,823 | A | | 4/1997 | Ruff et al. | |
| 5,619,828 | A | | 4/1997 | Ver Meer | |
| 5,647,172 | A | * | 7/1997 | Rokicki | 49/504 |
| 5,649,397 | A | | 7/1997 | Sauder | |
| 5,651,223 | A | * | 7/1997 | Novak et al. | 52/211 |
| 5,661,943 | A | | 9/1997 | Hagel | |
| 5,722,207 | A | | 3/1998 | Anderson et al. | |
| 5,758,458 | A | | 6/1998 | Ridge | |
| 5,873,209 | A | | 2/1999 | Hagel | |
| 5,950,391 | A | | 9/1999 | Hagel | |
| 6,098,351 | A | | 8/2000 | Mills | |
| 6,122,869 | A | * | 9/2000 | Richardson | 52/204.7 |
| 6,122,882 | A | | 9/2000 | Hagel | |
| 6,125,605 | A | | 10/2000 | Young | |
| 6,138,413 | A | * | 10/2000 | Fehr | 49/382 |
| 6,161,343 | A | | 12/2000 | Young | |
| 6,197,412 | B1 | * | 3/2001 | Jambois | 428/297.4 |
| 6,223,484 | B1 | | 5/2001 | Minter | |
| 6,343,438 | B1 | | 2/2002 | Boldt | |
| 6,343,448 | B1 | | 2/2002 | Lin | |
| 6,405,506 | B2 | | 6/2002 | Ruff | |
| 6,425,222 | B1 | | 7/2002 | Hagel | |
| 6,446,410 | B1 | | 9/2002 | Hagel | |
| 6,530,183 | B1 | | 3/2003 | Kuei-Yung | |
| 6,694,696 | B2 | | 2/2004 | Hagel | |
| 7,520,094 | B2 | * | 4/2009 | Davies | 52/204.1 |
| 7,533,503 | B2 | * | 5/2009 | Wang | 52/217 |
| 2002/0059772 | A1 | | 5/2002 | Hagel | |
| 2002/0139071 | A1 | * | 10/2002 | Banford | 52/204.1 |
| 2003/0005652 | A1 | | 1/2003 | Hagel | |
| 2007/0074469 | A1 | | 4/2007 | Plagemann et al. | |
| 2007/0209299 | A1 | * | 9/2007 | El Etel | 52/204.1 |
| 2008/0072506 | A1 | * | 3/2008 | LeGoff | 52/204.1 |
| 2008/0172957 | A1 | * | 7/2008 | Kerscher | 52/204.1 |
| 2008/0178541 | A1 | * | 7/2008 | Kerscher et al. | 52/204.1 |

OTHER PUBLICATIONS

Steve Ehle, Extrusion Process May Shape Component Manufacturing's Future, Wood Digest, Undated, 4 Pages, Strandex Corporation, Cincinnati, OH.

Endura Products, Inc., Opening. Closing. Performing., jambDam Frame Adapter, Copyrighted 2003, 7 Pages.

Imperial Prodcuts, Low Price Breakthru!, Advertisement in Shelter, Circle Reader Info No. 176, Oct. 2001, 1 Page.

Tecton Products LLC, Tecton Door System A Door is Only As Good As Its Frame, Product Literature, Believed to be first published in 2005, 3 pages.

Tecton Products LLC, Products Tecton Door System, www.tectonproducts.com/, Printed Mar. 27, 2006, 11 pages.

Advanced Fiber Products, Pultrusion Process, www.afpfiberglass.com/pultrusionProcess.asp, Printed Dec. 28, 2007, 2 pages.

Tecton Products LLC, Doorframes Tecton Introduces Fiberglass Entry Door, undated, 1 page.

* cited by examiner

FIG. 19
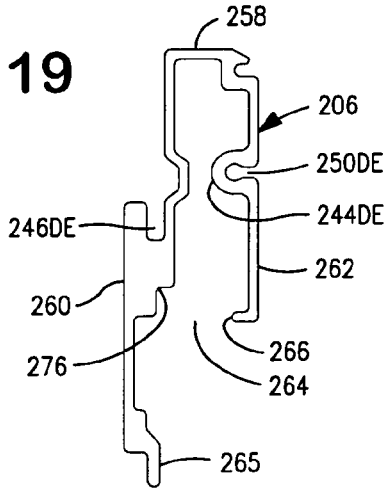
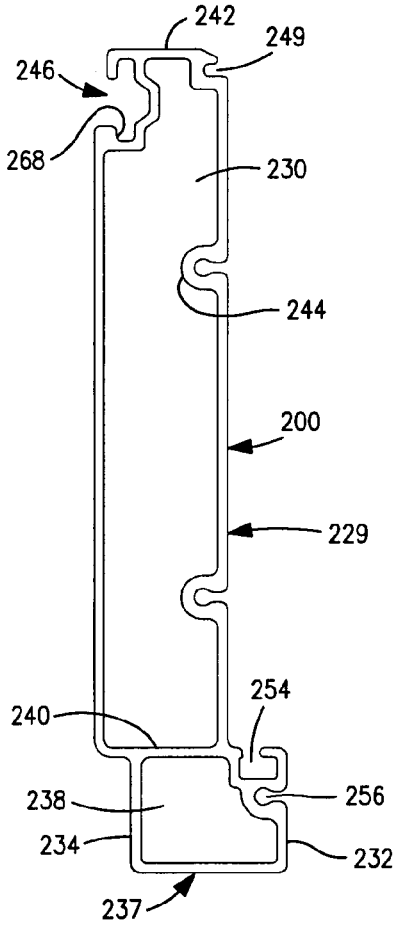
FIG. 17
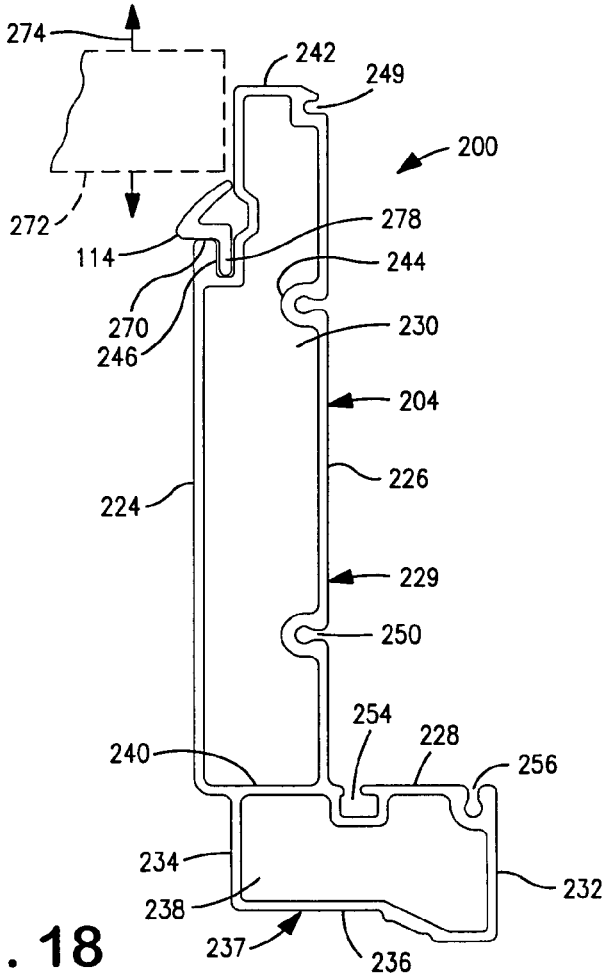
FIG. 18

DOOR FRAMES AND COVERINGS

CROSS REFERENCE TO RELATED APPLICATIONS

This Application is a Non-Provisional of U.S. Provisional Patent Application Ser. No. 60/885,121, filed Jan. 16, 2007.

BACKGROUND OF THE INVENTION

This invention relates in general to structural framing and cladding systems used in door frames for door assemblies which are used as structural components of buildings. More specifically, the invention relates to frames, frame kits, and jamb substrate coverings made using pultruded fiber reinforced polymeric (FRP), e.g. pultruded fiberglass, structures and wherein frames made from the frame kits, optionally including side light windows, are installed in doorway rough openings which serve as entrance points into a building, and the coverings are installed on door frame substrates.

As used herein, including in the claims which follow, reference to "entry" door frames is directed to doors which are sized and configured to facilitate ingress and egress of people into and out of a building.

As used herein, including in the claims which follow, reference to "garage" door frames is directed to doors which are sized and configured to facilitate ingress and egress of vehicles into and out of a building.

As used herein, including in the claims which follow, reference to "entrance" door frames is directed generically to all doors which facilitate ingress and egress into and out of a building, and thus includes both personnel entry doors as well as vehicular garage doors.

Historically, wood has been used to fabricate door jambs used in residential door frames. Wood has also been used to provide casings, also known as "trim" and "nosings", as part of a door frame. Wood is stiff, rigid, structurally tough, and readily attached to e.g. structural members of the building using nails, screws, and the like. Wood frames are painted to match the consumer's aesthetic specifications as well as to protect the wood from the effects of weathering. While wood readily accepts paint, wood frames require periodic repainting in order to maintain the aesthetic and protection attributes, especially to prevent the wood from being directly exposed to the weather, such as to ambient moisture, and rotting which accompanies such moisture exposure. So while wood provides a number of desirable qualities, wood also has some properties which are not desirable in an exterior door through which entrance is gained to the building.

As an improvement on painted wood, extruded aluminum cladding has been used to cover over wood frames. Extruded aluminum, however, is susceptible to wear and tear, for example denting and corrosion. While cladding obviates the need for periodic repainting, cladding does not address the issue of water wicking up into the frame from the bottom ends of the side jambs of the frame. Nor does cladding address the potential for rot or other wood deterioration which is typically associated with wicked water. Further, if the cladding is damaged, attempts at on-site repainting of the aluminum achieve less than desired results in terms of aesthetic appearance.

As another way of addressing the problems associated with wood door frames, it is known to use plastic and plastic-coated wood as replacements for wood frames. However, frames made with such materials are typically more expensive, and require more labor to produce and install, and some such structures are subject to undesired levels of expansion and contraction with changes in ambient temperature and/or changes in ambient moisture levels.

Thus, a recognized problem in the conventional art is that residential door frames and cladding require substantial user maintenance to prevent wear and tear, and degradation, and still may not achieve those objectives. Furthermore, previous door frame kit designs, including side light windows, were relatively expensive to produce and maintain. Thus, it is desirable to provide door frames and cladding made from material which is relatively durable and weather resistant. Further, it is desirable to provide consumers with maintenance free door frames and door frame cladding. Still further, it is desirable to provide such door frames which are cost-effective.

U.S. Pat. No. 6,343,438 Boldt (incorporated herein by reference in its entirety) discloses door frame kits, to be assembled into door frames, and door frames assembled from such kits. The Boldt '438 door frame kits include a top member, and first and second side members configured to be attached to the top member by screws or other connectors. The door frame kits disclosed in Boldt '438 comprise extruded aluminum structures, which define the top and side members of the door frame kit. Each top and side member includes the extruded aluminum structure, and a reinforcing wood insert recessed in a cavity in the extruded aluminum structure. A profile of such extruded aluminum structure defines the cavity which receives the substrate therein, wherein the substrate serves to structurally reinforce the extruded aluminum structure.

The door frames and cladding taught in Boldt '438 have certain disadvantages such as being susceptible to damage after exposure to the elements and from physical impacts by ingress and egress through the doorway, as well as less than desired results from repainting of damaged areas of the aluminum.

What is needed is a door frame and door frame kit and/or cladding kit which has members which are fabricated from a more durable, more maintenance-free material, e.g. the invented pultruded fiber reinforced polymeric material such as pultruded fiberglass. Such pultruded structure provides strength and protection desired of the door frame, as well as aesthetically pleasing appearance. Moreover, pultruded members can be fabricated and assembled to form a door frame, optionally with side light windows. Alternatively a kit containing such members can be provided in disassembled form, and assembled at the installation site. Further, pultruded FRP frame and mullion cladding can be applied to a frame or substrate prior to reaching, or at, an installation site.

These and other needs are alleviated, or at least attenuated, by the novel products and methods of the invention.

SUMMARY

The present invention is directed to frames, kits, and coverings constructed from fiber reinforced polymeric materials (FRP), e.g. pultruded fiberglass.

Pultruded fiberglass frames exhibit desirably limited expansion and contraction when exposed to changes in ambient temperatures. In addition, pultruded fiberglass is desirably resistant to denting, weather conditions, and other various wear and tear which is normally experienced by door frames. Pultruded fiberglass is also not subject to undesirable levels of corrosion, is, lighter than wood or aluminum, and is moisture resistant.

In a first family of embodiments, the invention comprehends a building entrance door jamb pultruded structure, adapted to be assembled into a building entrance door and attached to building structural members at a doorway rough opening in an exterior wall of a building. The pultruded structure has a front, a rear, a door-facing side, a building-facing side, a length, a depth between the front and the rear, and a thickness between the door-facing side and the building-facing side. The pultruded structure comprises an elongate fiber-reinforced pultruded polymeric nosing defining a first front cavity extending along the length of the pultruded structure and from the front toward the rear; and an elongate fiber-reinforced pultruded polymeric jamb body comprising a front wall at a front of the jamb body, a closed back wall, and side walls extending from the front of the jamb body to the back wall, the elongate pultruded structure defining a generally closed perimeter, devoid of receptacles capable of receiving a body of a reinforcing substrate.

In some embodiments, the profile has an overall nominal thickness of 0.075 inch to 0.100 inch.

In some embodiments, the jamb body defines a second cavity, open to the first cavity.

In some embodiments, the invention comprehends a building entrance door frame made with a pultruded structure of the invention.

In a second family of embodiments, the invention comprehends a building entrance door frame kit, comprising a top jamb member, and first and second side jamb members configured to be coupled to the top jamb member to make a door frame assembly, and wherein the door frame assembly is adapted to be attached to building structural members at a doorway rough opening in an exterior wall of a building, the top jamb member, and the first and second side jamb members each have a front, a rear, a door-facing side, a building-facing side, a length, a depth, and a thickness. The jamb members comprise an elongate fiber-reinforced pultruded polymeric covering structure having a front, a rear, a door-facing side, and an opposing building-facing side, a length defined along a long dimension of the pultruded structure, a depth between the front and the rear, and a thickness between the door-facing side and the opposing building-facing side. The pultruded structures comprise a nosing defining a first front cavity extending along the length of the pultruded structure, and from the front toward the rear of the respective jamb member, and a jamb cover defining a second rear cavity extending from the nosing toward the rear of the respective said jamb member, and terminating at an elongate rear open end extending along substantially the entirety of the length of the jamb member. The jamb further comprises an elongate generally rigid jamb substrate having a length, a depth, and a thickness, the jamb substrate being received in the rear cavity and extending from the nosing rearwardly through the rear end of the rear cavity and out of the rear cavity to a rear end of the substrate disposed rearwardly of the rear end of the rear cavity; and fasteners adapted to assemble the side jamb members to the top jamb member thereby to fabricate a door frame.

In some embodiments, the elongate substrate is an elongate polymeric substrate.

In some embodiments, the pultruded structure is a one-piece pultruded structure.

In some embodiments, the jamb cover is defined by way of first and second pultruded profiles joined to each other in an assembly process.

In some embodiments, a weather seal strip extends rearwardly of any the pultruded jamb cover.

In some embodiments, the rear cavity is open to the front cavity.

In some embodiments, a pultruded mounting fin is integral with the pultruded covering structure.

In some embodiments, the invention comprehends a building entrance door frame made with a kit of the invention.

In some embodiments, the top jamb member has an arcuate curvature along its length, and wherein the covering structure covering the top jamb member comprises a molded fiberglass profile having an arcuate curvature along its length, corresponding to the arcuate curvature of the top jamb member in place of the pultruded covering structure.

In some embodiments, the top jamb member is a curved fiber reinforced, generally closed-perimeter polymeric jamb, with one or more internal cavities, and optional depth extender.

In a third family of embodiments, the invention comprehends a building entrance door jamb, adapted to be coupled to second and third door jambs to make a door frame assembly, where the door frame assembly is adapted to be attached to building structure members at a doorway rough opening in an exterior wall of a building. The jamb has a front, a rear, a door-facing side and an opposing building-facing side, a length, a depth between the front and the rear, and a thickness between the door-facing side and the building-facing side. The jamb further comprises an elongate fiber-reinforced pultruded polymeric jamb block having a profile extending along the length of the door jamb and comprising a front wall, a closed rear wall, a first side wall on a door-facing side of the jamb, and a second side wall on a building-facing side of the jamb, the first and second side walls extending from the front of the jamb block to the rear wall, the front wall, the rear wall, and the side walls defining a rear cavity. The jamb further comprises an elongate fiber reinforced pultruded polymeric nosing block extending along the length of the door jamb and defining a front cavity, the nosing block having a rear wall in common with the front wall of the jamb block, the elongate jamb defining a generally closed perimeter at the rear of the jamb, devoid of receptacles capable of receiving a body of a reinforcing substrate.

In some embodiments, the nosing has a rear wall in common with a front wall of the jamb block.

In some embodiments, the jamb block further comprises a mounting cavity having a main chamber, and a locking chamber extending from the main chamber.

In some embodiments, the jamb further comprises a weather seal, the weather seal comprising a mounting stud and a seal fin strip extending from the mounting stud, the mounting stud comprising a main body received in the main chamber of the mounting cavity and an ear extending from the main body and into the locking chamber of the mounting cavity.

In some embodiments, the mounting cavity is disposed in the vicinity of the rear wall.

In some embodiments, the jamb further comprises a lock receptor in the vicinity of the rear wall and spaced from the mounting cavity.

In some embodiments, the jamb further comprises an elongate fiber-reinforced pultruded polymeric depth extender, the depth extender having a profile extending along the length of the door jamb, and being mounted to the jamb block.

In some embodiments, the depth extender comprises a rear wall, a third side wall on the door-facing side of the jamb, a fourth side wall on the building-facing side of the jamb, the third and fourth side walls extending from the rear of the depth extender to the front of the depth extender, the third side wall terminating in a mounting finger strip locked in a mounting cavity on the jamb block and the fourth side wall terminating in a locking stud strip locked in the lock receptor on the jamb block, whereby the depth extender is locked to the jamb block, at the rear of the jamb block, by the locking finger strip and the locking stud.

In a fourth family of embodiments, the invention comprehends an elongate fiber-reinforced pultruded polymeric depth extender adapted to be mounted on a jamb base thereby to extend a depth of a door jamb. The depth extender has a front and a rear, and comprises a pultruded rear wall; a pultruded first side wall extending toward the front of the depth extender, on a door-facing side of the depth extender; and a pultruded second side wall extending toward the front of the depth extender, on a building-facing side of the depth extender, the first and second pultruded side walls extending from the rear of the depth extender toward the front of the depth extender, the pultruded first side wall terminating in a mounting finger adapted to be locked in a mounting cavity in the jamb base and the second pultruded side wall terminating in a locking stud adapted to be locked in a lock receptor on the jamb base.

In some embodiments, the first and second pultruded side walls define a central cavity therebetween extending frontwardly from the rear wall, the locking finger and the locking stud extending inwardly toward the central cavity.

In some embodiments, the locking finger extends, from where the locking finger extends inwardly toward the central cavity, toward the front of the depth extender and away from the rear wall.

In some embodiments, the jamb further comprises a mounting cavity spaced from the locking finger.

In some embodiments, the depth extender further comprises a mounting cavity on the first side wall and spaced from the locking finger.

In some embodiments, the depth extender further comprises a lock receptor in the vicinity of the rear wall and spaced from the mounting cavity.

In some embodiments, the depth extender further comprises a lock receptor in the vicinity of the rear wall and spaced from the mounting cavity.

In some embodiments, the depth extender further comprises a corner recess on an inner surface of the first side wall adjacent the mounting cavity.

In a fifth family of embodiments, the invention comprehends a building in-swing personnel entrance door jamb, adapted to be coupled to second and third door jambs to make a door frame assembly, and wherein such door frame assembly is adapted to be attached to building structure members at a doorway rough opening in an exterior wall of a building. The resulting frame has a front, a rear, a door-facing side and an opposing building-facing side, a length, a depth between the front and the rear, and a thickness between the door-facing side and the building-facing side. The door frame further comprises an elongate fiber-reinforced pultruded polymeric jamb block having a profile extending along the length of the door jamb and comprising a front wall, a closed rear wall, a first side wall on a door-facing side of the jamb, and a second side wall on a building-facing side of the jamb, the first and second side walls extending from the front of the jamb block to the rear wall, the front wall, the rear wall, and the side walls defining a rear cavity, further comprising a door latch-side abutment surface on the first side wall and spaced from the front wall; and an elongate fiber reinforced pultruded polymeric nosing block extending along the length of the door jamb and defining a front cavity, the nosing block having a rear wall in common with the front wall of the jamb block, the elongate jamb block defining a generally closed perimeter at the rear, devoid of receptacles capable of receiving a body of a reinforcing substrate.

In some embodiments, the jamb further comprises a strip receiving cavity in the first side wall adjacent the latch-side abutment surface, and a weather seal strip in the strip receiving cavity.

In some embodiments, the jamb further comprises a strip receiving cavity in the first wall adjacent the latch-side abutment surface, and a lock receptor in the vicinity of the rear wall and spaced from the strip receiving cavity.

In some embodiments, the depth extender comprises a second rear wall, a third side wall on the door-facing side of the jamb, a fourth side wall on the building-facing side of the jamb, said third and fourth side walls extending from the second rear wall to the front of the depth extender, the third side wall terminating in a mounting finger strip locked in the strip receiving cavity in the first side wall of the jamb block, and the fourth side wall terminating in a locking stud locked in the lock receptor on the jamb block, whereby the depth extender is locked to the jamb block, at the rear of the jamb block, by the locking finger strip and the locking stud.

In some embodiments, the depth extender further comprises a second mounting cavity in the vicinity of the rear wall of the depth extender.

In some embodiments, the jamb further comprises a second lock receptor in the vicinity of the second rear wall and spaced from the second mounting cavity.

In some embodiments, the jamb further comprises a weather seal mounted in the second mounting cavity.

In a sixth family of embodiments, the invention comprehends a building personnel entrance door frame comprising a top jamb member, and first and second side jamb members configured to be coupled to the top jamb member to make a door frame assembly, and wherein the door frame assembly is adapted to be attached to building structural members at a doorway rough opening in an exterior wall of a building. The top jamb member, and the first and second side jamb members each have a front, a rear, a door-facing side, a building-facing side, a length, a depth, and a thickness. The jamb members comprise an elongate fiber-reinforced pultruded polymeric covering structure having a profile defining a front, a rear, a door-facing side and an opposing building-facing side, a length defined along a length dimension of the pultruded structure, a depth between the front and the rear, and a thickness between the door-facing side and the opposing building-facing side. Such pultruded structures comprise a nosing defining a first front cavity extending along the length of the pultruded structure, and from the front toward the rear of the respective jamb member, and a jamb cover having a front wall, and first and second side walls corresponding with the door-facing side of the pultruded structure and the building-facing side of the pultruded structure, the front wall and the side walls collectively defining a second rearwardly-opening rear cavity extending from the nosing toward the rear of the respective jamb member, the rear cavity having a rear end corresponding with rear ends of the side walls. The jamb further comprises an elongate generally rigid jamb substrate having a depth, and a thickness. The jamb substrate is received in the rear cavity and extends from the nosing rearwardly through the rear end of the rear cavity, and out of the rear cavity to a rear end of the substrate disposed rearwardly of the rear end of the rear cavity, the jamb member further comprising an in-swing door latch-side abutment surface at a rearwardly-disposed portion of the jamb member.

In some embodiments, the latch-side abutment surface is located rearwardly of the rear end of the side wall which is on the door-facing side of the pultruded structure.

In some embodiments, the elongate substrate is an elongate polymeric substrate.

In some embodiments, the top jamb member has an arcuate curvature along its length, and the covering structure covering the top jamb member comprises a molded fiberglass profile having an arcuate curvature, along the length of the jamb, corresponding to the arcuate curvature of the top jamb member in place of the pultruded covering structure.

The present invention will be further appreciated and understood when considered in combination with the following description and the accompanying drawings. It should be understood, however, that the following description is given by way of illustration and not of limitation. Certain changes and modifications can be made within the scope of the invention without departing from the spirit of the invention, and the invention includes all such changes and modifications.

BRIEF DESCRIPTION OF THE DRAWINGS

FIG. 17 illustrates an end view of another embodiment of a pultruded jamb base for use in a garage door frame of the invention.

FIG. 18 illustrates an end view of a pultruded fiberglass jamb base along with a weather strip mounted therein, for use in an in-swing personnel door frame of the invention.

FIG. 19 illustrates an end view of a pultruded depth extender of the invention which can be mounted to the jamb base of FIG. 18.

Figure 1:
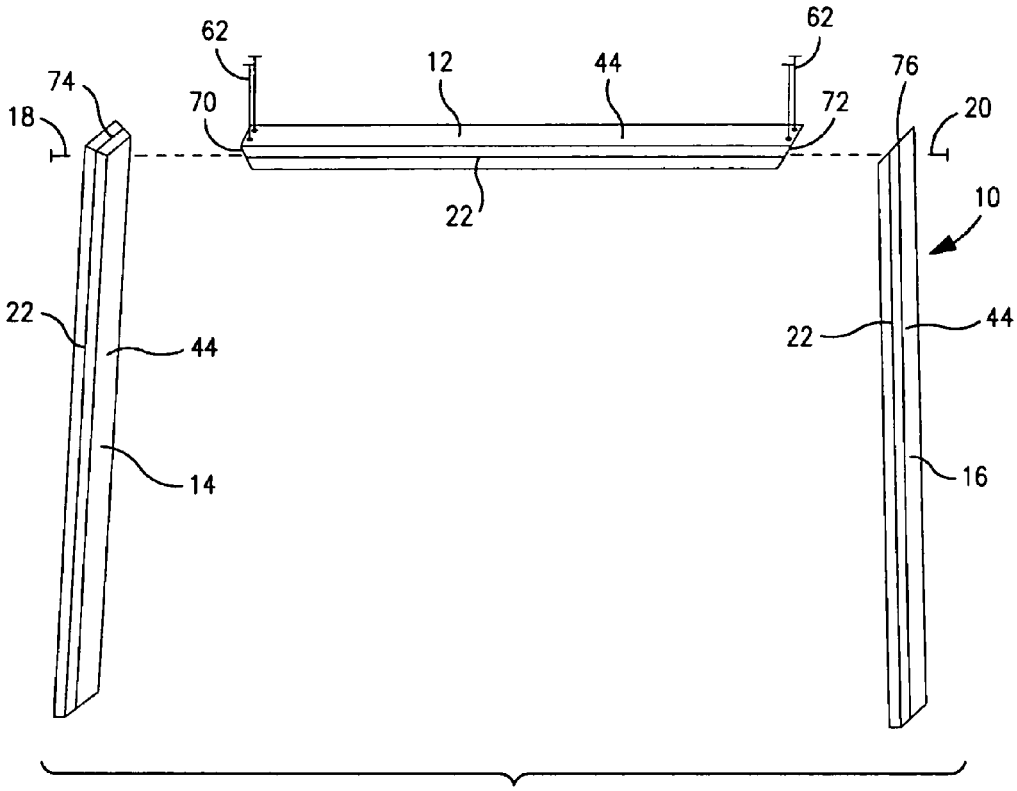
FIG. 1 illustrates an exploded pictorial view of a garage door frame of the invention.

The invention is not limited in its application to the details of construction, or to the arrangement of the components set forth in the following description or illustrated in the drawings. The invention is capable of other embodiments or of being practiced or carried out in various other ways. Also, it is to be understood that the terminology and phraseology employed herein is for purpose of description and illustration and should not be regarded as limiting. Like reference numerals are used to indicate like components.

DETAILED DESCRIPTION OF THE ILLUSTRATED EMBODIMENTS

A door frame of the present invention includes a top member and two side members attached thereto, wherein the top and side members include fiber-reinforced pultruded structures. The two side members are attached to the top member and optionally to a threshold at the bottom of the frame, thereby to define a door frame assembly. The threshold can be either a pultrusion, or conventional aluminum or wood, or combination of any of the above. The members of the resulting door frame, namely the door frame itself, are typically attached to structural members which define a doorway rough opening in a building into which the door frame assembly is inserted. The heights and widths of the top and side members, and the optional threshold, are configured to correspond to the respective heights and widths in the door frame assembly. The top member, the side members, and the threshold can be provided in a variety of shapes, colors, and sizes.

The drawings illustrate the invention as door frames made entirely of pultruded structures, and as door frames made with pultruded structures mounted on wood or polymeric substrates. Such substrates, also referred to herein as inserts, optionally as jambs, are sized and configured similar to conventional wood door jambs.

Referring to FIG. 1, a conventional door frame kit 10 is shown where kit 10 includes a top member 12, a first side member 14, and a second side member 16. Side members 14 and 16 are to be mounted to opposite ends of top member 12. Fasteners, such as mounting screws 18, 20 are used to secure the side members 14 and 16 to top member 12.

Figure 2:
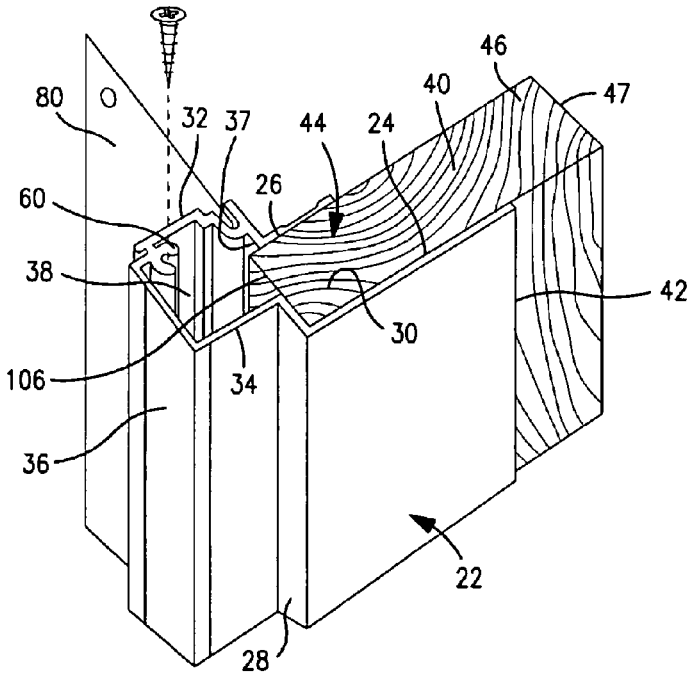
FIG. 2 shows a cross-section of a pultruded garage door frame top member or side member of the invention, on a wood jamb, illustrating a one-piece pultruded fiberglass structure of the invention.

Referring to FIG. 2, a cross section of a typical top or side member 12, 14, 16 is shown. As shown, a such top or side member in general comprises a pultruded fiberglass structure 22, mounted as a covering on a wood substrate 44. Such pultruded covering structure 22 can be incorporated into a top member 12 or a side member 14 or 16 when a door frame is initially assembled.

Pultruded fiberglass covering structure 22 has facing side walls 24, 26, and an end wall 28 which collectively define a rearwardly-disposed elongate cavity 30 therebetween, the rearwardly-disposed cavity being open to the rear of the pultruded structure. Stub wall 32, stub wall 34, front wall 36, and rear wall 37 collectively define a frontwardly-disposed cavity 38, which opens at its rear into rearwardly-disposed cavity 30.

Cavity 30 is generally defined between side walls 24 and 26, from end wall 28 to the open end 40 of the cavity adjacent the rear-most edge 42 of the pultrusion. As defined herein, cavity 30 generally does not include elongate front cavity 38, which extends the length of the pultruded structure between stub walls 32 and 34, front wall 36, and rear wall 37.

An e.g. wood board, sized and configured similar to a conventional wood jamb, is received in cavity 30 as substrate 44, and typically fills the cavity between side walls 24 and 26, and end wall 28, and extends rearwardly in cavity 30 from end wall 28 to a portion 46 of the substrate which extends rearwardly beyond open end 40 of the cavity and beyond rear edge 42 of the pultruded structure 22. Substrate 44 is typically installed in cavity 30 during manufacture of the respective top or side jamb member and is accordingly present in the jamb member when the door frame or door frame kit is shipped from the frame manufacturing facility to, for example, the construction site. Conventional fasteners such as nails or screws can be used, as desired, to aid in securing substrate 44 within cavity 30. Substrate 44 structurally reinforces pultruded fiberglass structure 22 such that the substrate and the pultrusion cooperate and work together to make a strong, dimensionally-stable jamb assembly which is not easily bent or twisted. Typically, substrate 44 substantially fills rearwardly-disposed cavity 30 between the respective opposing side walls 24, 26, thus additively providing its own resistances to compression, bending, and twisting to the compressive, bending, and twisting resistances of pultruded structure 22. Such side or top member has a length, a depth extending from front wall 36 of the nosing to the rear end 47 of substrate 44, and a thickness which extends from side wall 24 to side wall 26.

Figure 3:
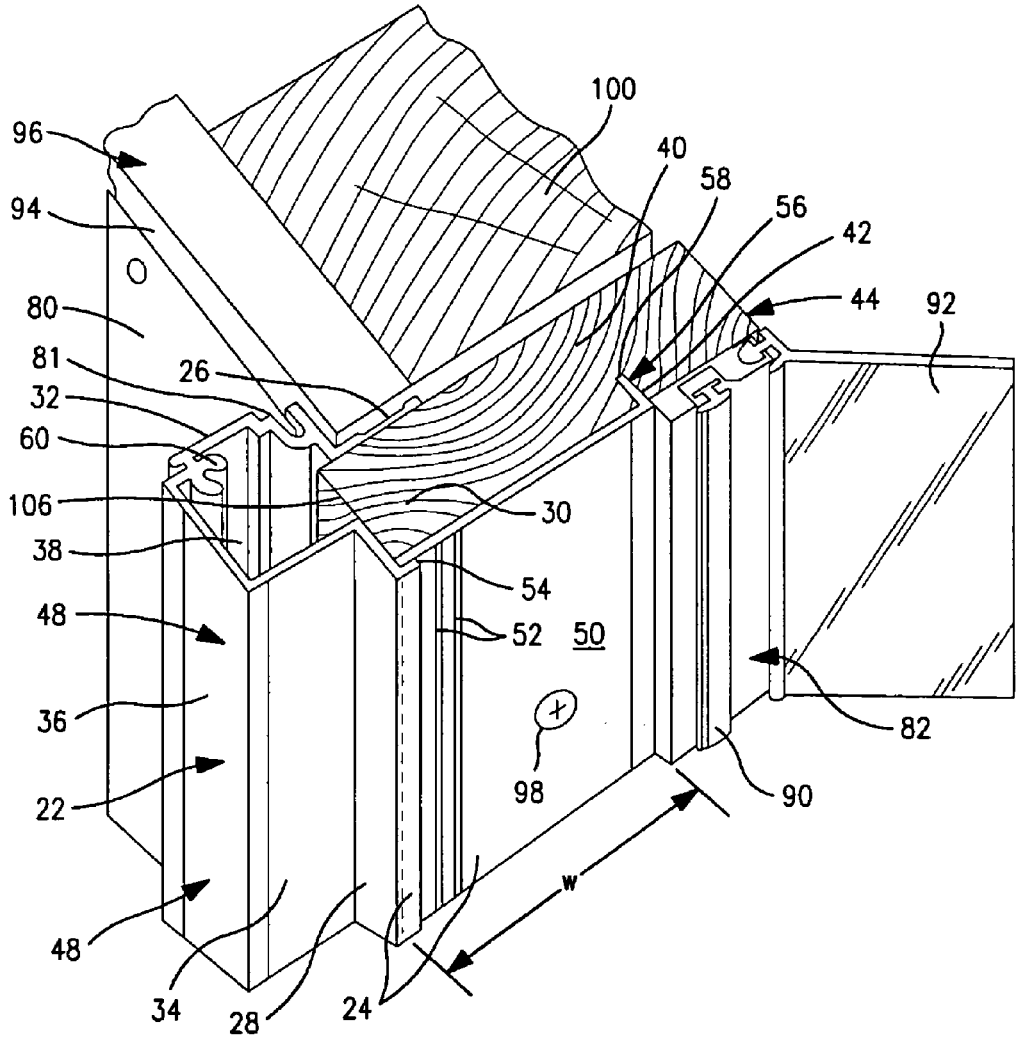
FIG. 3 shows a cross-section as in FIG. 2, illustrating a second embodiment, comprising a two-piece pultruded fiberglass structure of the invention installed on a wood jamb, with a weather seal assembly also installed on the wood substrate.

In a second embodiment illustrated in FIG. 3, fiberglass pultruded structure 22 collectively comprises in combination a first outer fiberglass pultrusion 48 and a second substrate cover pultrusion 50. Substrate cover 50 includes a number of elongate outwardly-facing ridges 52, including an end ridge 54. During assembly of the respective top or side member, one or more ridges 52 can be intentionally broken away from the main body of substrate cover 50 in order to reduce the width "W" of substrate cover 50 to cooperate with the depth of the respective substrate 44. If no such reduction is needed, or after such reduction has been made, the end outwardly facing ridge 52 on the substrate cover then interfaces with a corresponding inwardly-facing ridge on outer pultrusion 48 whereby substrate cover 50 and outer pultrusion 48 are joined together and cooperate to form the two-piece fiberglass pultruded structure 22.

As with the embodiments of FIG. 2, in the embodiments of FIG. 3, substrate 44 typically substantially fills rearwardly-disposed cavity 30 between side walls 24 and 26, thus additively providing its own resistances to compression, bending, and twisting to the compressive, bending, and twisting resistances of pultruded structure 22. In the embodiments illustrated, inwardly turned lip 56 on pultruded cover 50 is inserted into, and interfaces with, cooperating groove 58 in substrate 44 to aid with the positioning of substrate 44 in rear cavity 30.

Fiberglass pultrusion 22 includes screw receiver channel structure 60, which facilitates positioning side members 14, 16 with respect to top member 12, and thereby facilitates mounting side members 14, 16, to top member 12. Screws 18, 20 (FIG. 1) extend through respective apertures (not shown) in side members 14, 16 and into screw receivers 60 in top member 12, thus positioning and providing initial mounting, of the side members to the top member. Additional screws 62 are driven through the substrate 44 of top member 12 into the substrates 44 of side members 14, 16, thus further securing the top member to the side members where the substrate 44 of top member 12 interfaces with the substrates 44 of respective side members 14, 16. Accordingly, side members 14, 16 are properly positioned with respect to top member 12 by screws 18, 20 and screw receivers 60.

Fasteners 18, 20, 62 can all extend through the side members into the top member, can all extend through the top member into the side members, or some can extend through the side members into the top member and some through the top member into the side members. Suitable numbers and types of fasteners 18, 20, and 62 can be readily selected by those skilled in the art.

Figure 4:
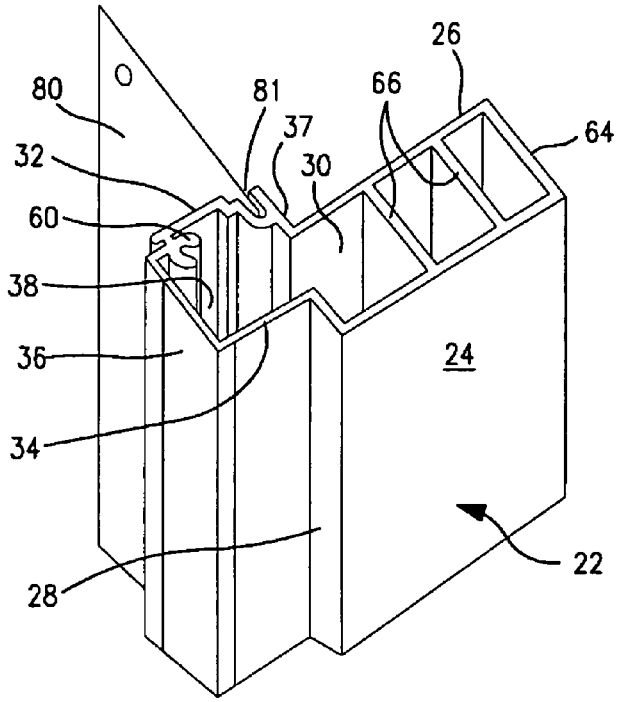
FIG. 4 shows a cross-sectional view of a third embodiment of door frame side and top members of the invention, comprising a fully-enclosed fiberglass pultruded structure, and no wood insert/jamb/substrate.

A third embodiment of pultruded fiberglass structure 22 is shown in FIG. 4. In this embodiment, pultruded fiberglass structure 22 has a frontwardly-disposed nosing defined by walls 32, 34, 36, 37, and a rearwardly-disposed jamb body defined by walls 24, 26, 28, 64. Structure 22 is fully enclosed on its front, rear, and side walls, and generally defines the entirety of the structural portion of the jamb. Namely, open edge 40 at the rear of the pultrusion has been closed off. Side wall 26 is the same length as side wall 24, though equal lengths is not a limitation. The opening between side walls 24, 26 is closed off by back wall 64. At least one support web 66 (two support webs are shown) extends across cavity 30 between side walls 24, 26 structurally reinforcing the enclosed pultruded fiberglass structure along the length of enclosed structure 22. Aligned mounting holes (not shown) are provided through side walls 24, 26 at spaced locations along the length of the jamb for mounting the jamb to frame members of a doorway opening to which the door jamb is to be mounted, using conventional fasteners. The structure of front cavity 38, including stub walls 32, 34, front wall 36, and rear wall 37, is substantially the same as in FIGS. 2 and 3.

An FRP, e.g. fiberglass-based pultruded structure provides significant advantages over any use of aluminum. Specifically, pultrusions provide the needed strength and corrosion resistance, and a desired level of thermal barrier, while providing a door frame which is relatively light in weight.

Figure 6:
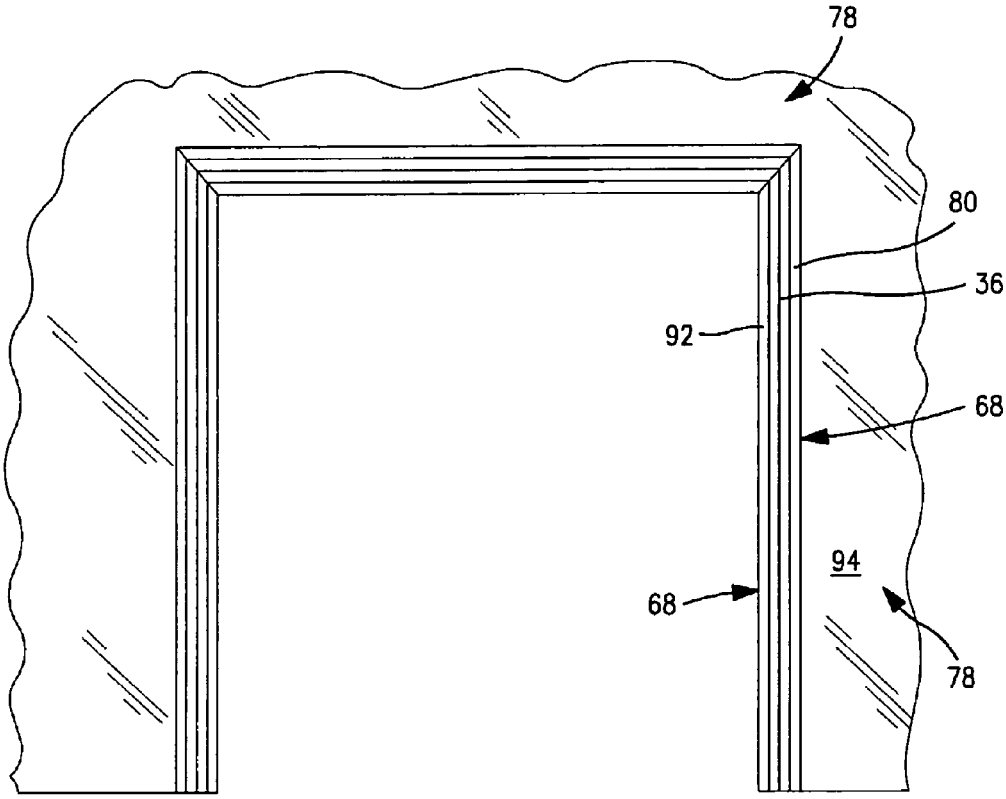
FIG. 6 shows the door frame of FIG. 1 assembled, and inserted into a garage door rough opening in a building.

Certain aspects of the invention are seen when the door frame kit has been assembled to form a door frame assembly 68 (FIG. 6). As seen in FIGS. 1 and 6, the ends 70, 72 of the top member and the respective ends 74, 76 of the side members are cut at cooperating angles, preferably angles of about 45 degrees, to facilitate forming mitered square corner joints when the members are mounted to each other.

Door frame 10, including all embodiments shown, is preferably assembled to make a respective door frame assembly 68 prior to inserting the door frame assembly into the doorway rough opening of the building. Thus, the members of door frame kit 10 generally do not interface with, or interact with, the door opening prior to completion of assembly of the door frame. After a kit has been assembled, the completed door frame assembly 68 is inserted, as a unit, into the doorway rough opening of the building 78. The portions 46 of the substrates 44 which extend outwardly from the cavity 30 provide mounting loci for mounting the door frame assembly to the material forming the doorway rough opening of the building (e.g. wood or steel framing). Nails, screws, or like fasteners are typically inserted through substrate 44 and into the material forming the doorway rough opening to secure the door frame assembly to the building, in the doorway rough opening. In the instances of the embodiments of FIG. 4, the fasteners are driven through side walls 24, 26, at spaced locations along the length of pultruded structure 22, and into the material forming the doorway rough opening to secure the door frame assembly to the building in the doorway rough opening.

To aid in positioning the door frame assembly 68 within the doorway rough opening, a positioning strip (e.g. nail fin) 80 can be mounted in a nail fin kerf 81 in pultruded fiberglass structure 22 for interfacing with an outer surface 94 of a member of an outer wall structure of building 78, for thus holding the positioning of the door frame assembly within the doorway rough opening and aligning the door frame assembly with the outer wall of the building. Typically, positioning strip 80 interfaces with the outer surface 94 of sheathing 96 or like layer of the wall which is located interiorly of the outer layer (e.g. siding) of the wall structure.

Figure 5:
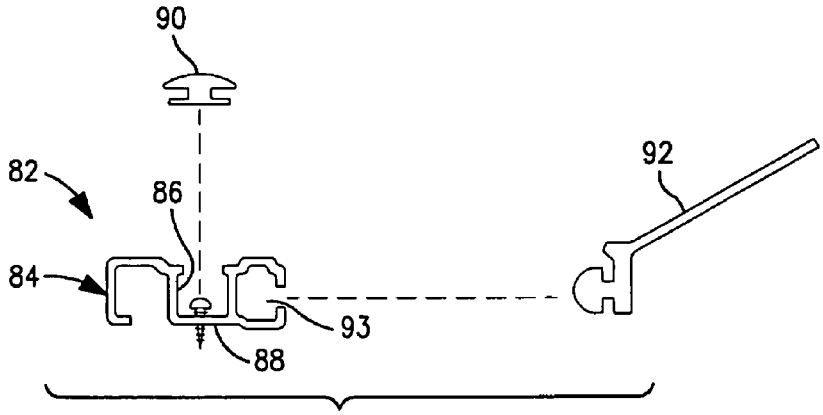
FIG. 5 shows an exploded view of a weather strip assembly useful in door frames of the invention.

Pultruded fiberglass structure 22 aids in protecting, from weather and the like, that portion of substrate 44 which is received in cavity 30, while leaving uncovered that portion of the substrate which extends from the cavity. A weather strip assembly 82 as shown in FIGS. 3 and 5 can be mounted on that portion of the substrate which extends outwardly from cavity 30. Use of weather strip assembly 82 results in essentially complete coverage of those portions of the substrate which face the doorway opening which is defined by door frame assembly 68, such that pultruded fiberglass structure 22 and weather strip assembly 82, in combination, provide a maintenance-free surface to that portion of the door frame which faces into the doorway opening. Weather strip can similarly be mounted to side wall 24 of the pultruded structure illustrated in FIG. 4, again to provide a weather seal capability to the resulting top or side member 12, 14, 16.

An exemplary weather strip assembly 82 of the invention is seen in FIG. 5. In weather strip assembly 82, an elongate base structure 84 has a channel structure 86 which extends along substantially the full length of mounting structure 84. The base structure can be mounted by screws, nails, or the like to a top or side member 12, 14, or 16. Back wall 88 of channel structure 86 interfaces with the respective pultruded top or side member 12, 14, 16.

Channel cover 90 is mounted to channel structure 86 after base structure 84 has been mounted, such as with screws, to the door frame at side wall 24, the channel cover thus covering the channel and the fasteners which fasten the weather strip assembly to the top or side member 12, 14 or 16, after base structure 84 has been mounted to the door frame.

Weather seal strip 92 is inserted into strip mounting structure 93 to provide a weather seal between door frame assembly 68 and the door which operates within the door opening defined by door frame assembly 68. Typically, seal strip 92 is polyvinyl chloride or other suitably flexible polymeric material.

Typically, weather strip assemblies 82 are mounted to top and side members 12, 14, 16 after the top and side members have been joined to each other to form door frame assembly 68, optionally after door frame assembly 68 has been installed in the doorway rough opening.

While not limiting, door frame kits or completed door frame assemblies of the invention are generally sized and configured to serve as door frames (i) for entry and egress of vehicles such as automobiles and trucks into and out of a building, namely to serve as door frames for garage doors, or (ii) for entry and egress of people into and out of a building, namely to serve as frames for entry doors.

For garage door frames, the size of the opening defined between side members 14, 16 of a completed door frame assembly is sufficient to receive a door having a nominal width of at least 72 inches, with widths of at least 84 inches being more typical. Door frame kits and completed door frame assemblies of the invention are readily adapted to receive garage doors having widths of typical double garage doors such as 15 feet width or 18 feet width. Greater widths are contemplated, especially where more robust fiberglass pultrusion structures 22 and/or substrates 44 are employed.

For entry door frames, the opening defined between side members 14, 16 of a completed door frame assembly is typically sized and configured to receive a door having a nominal width of 30 inches to 42 inches, with nominal widths of 36 inches to 42 inches being more typical. Frames for door slabs smaller than 30 inches and greater than 42 inches are contemplated as also being feasible, though less commonly employed.

Referring to FIG. 6, door frame kit 10 of FIG. 1 is shown, assembled into a door frame assembly 68, and inserted into a doorway rough opening of building 78. Positioning strips or mounting fins 80, mounted to the pultruded fiberglass structures 22, interface with outer surfaces 94 of the outer wall of the building to aid in positioning and holding the door frame assembly in the doorway rough opening, and aligning the door frame assembly with the outer wall of the building. With the frame thus positioned, screws or nails or other fasteners are driven through the mounting fin and into the building framing thus to temporarily hold the door frame in position in the rough opening.

With the frame assembly thus located and aligned in the doorway rough opening, by mounting fins 80, any final positioning adjustments are made, and the door frame assembly is permanently secured to the building at the doorway rough opening by driving nails, screws, or other fasteners through substrates 44, optionally through portions 46 of the substrates 44 which extend outwardly of cavities 30, optionally through side walls 24, 26 and into the building framing elements which form the doorway rough opening in the building. Substrates 44 thus provide mounting loci for mounting the door frame assembly to the building framing elements at the doorway rough opening. Any other effective fastening system can be used to secure the door frame assembly in the doorway rough opening. The e.g. garage door, or personnel door slab, as the case may be, is then hung in the door opening defined within the door frame.

Weather strip assemblies 82 are then mounted to the substrates 44, if not previously mounted. In garage door frames, weather strip assemblies 82 generally cover portions of the substrates 44 which extend from the pultruded fiberglass structures 22 and generally cover those portions which would otherwise be exposed to the weather in a typical building installation. The combination of the pultruded fiberglass structures 22 and the weather strip assemblies 82 result in substantially complete coverage of those portions of the substrate which, in a garage door frame, would otherwise be exposed to the weather, thereby providing a maintenance-free door frame. After the weather strip assembly 92 has been mounted to the frame, channel cover 90 is mounted to the weather strip assembly 82 to cover the respective channel.

Figure 7:
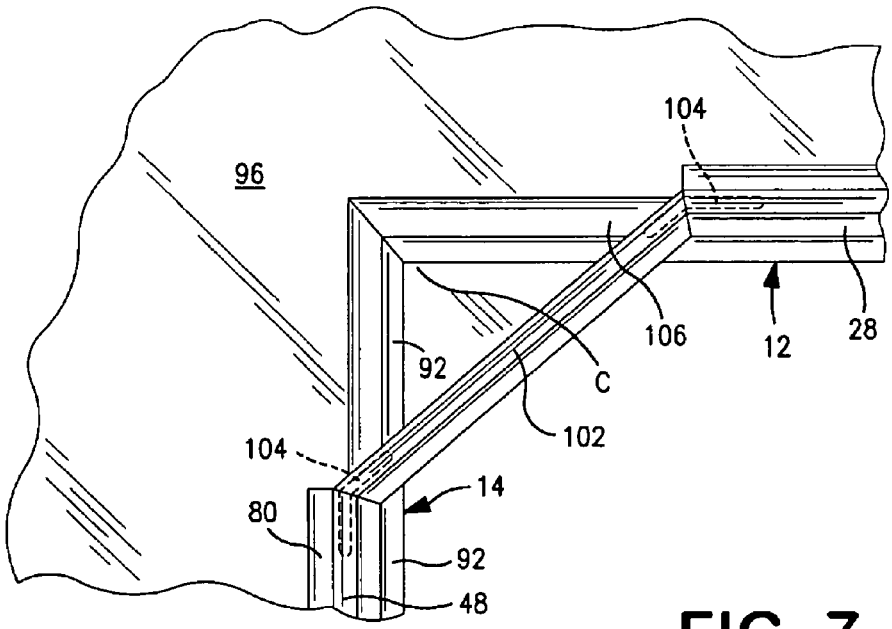
FIG. 7 illustrates, in enlarged elevated view, an embodiment of a top corner of a garage door assembly of the invention.

The relationship between the finished door frame assembly and the door opening in the building is illustrated in FIGS. 3, 6, and 7. As seen there, nail fin 80 interfaces with outer surface 94 of sheathing 96 of the building, and is nailed or screwed to the sheathing as desired. In the embodiments of FIG. 3, screws 98 are spaced along the length of the jamb at e.g. side wall 24, and extend through side wall 24 and substrate 44, into frame member 100, and thus secure frame assembly 68 to building frame member 100.

In another embodiment of the invention illustrated in FIG. 7, gussets 102 extend across the left and right corners of the frame, between top member 12 and side members 14, 16. At each such corner, a gusset 102, formed from a fiberglass pultrusion, extends across the respective corner as shown in FIG. 7. Gussets 102 are secured to pultruded structures 22 at each corner by gusset brackets 104. Gusset brackets 104 can be channel-shaped metal structures which are friction-fitted into front cavities 38 in pultruded structures 22 between front surfaces 106 of the respective substrates 44 and front walls 36 of the respective cavities 38.

In door frames having gussets 102, pultruded structures 22 on top member 12 and the respective side members extend only to the respective gusset 102, and do not cover substrate 44 or sheathing 96 between gusset 102 and the corner "C". Accordingly, surface 106 of substrate 44 is typically not covered or otherwise protected by any element of door frame assembly 68. Rather, surface 106 is covered by a corner portion of sheathing 96 which extends into the triangular-shaped space defined by gusset 102 and corner portions of the respective top and side members.

Figure 8:
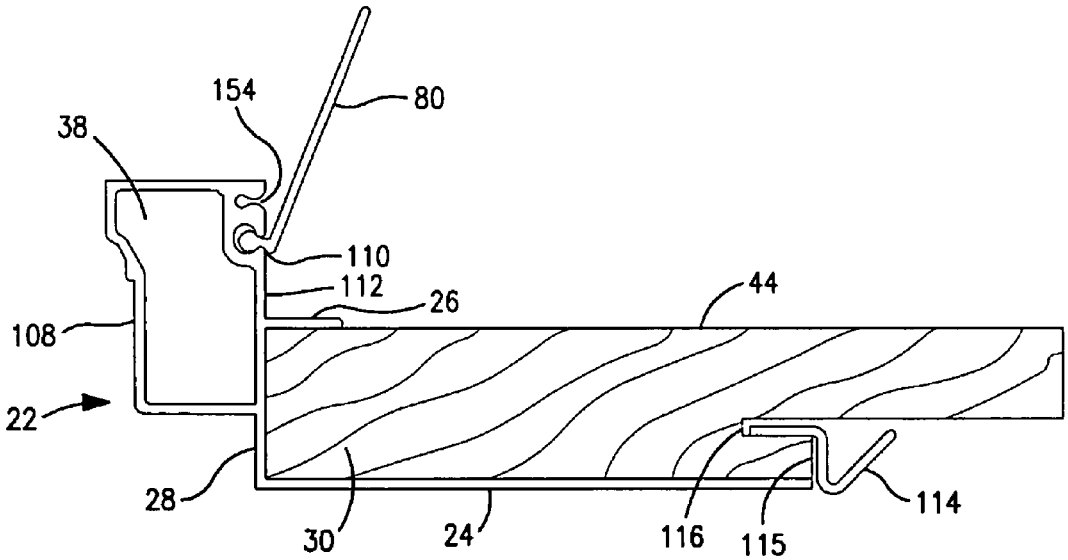
FIG. 8 illustrates an end view of a pultruded structure of the invention installed on a wood jamb, which pultruded structure can be used in a personnel entry door frame.

FIG. 8 shows an end view of another embodiment of pultruded fiberglass structure 22, mounted on a substrate 44, and having an integral fully enclosed brickmold nosing 108 enclosing a front cavity 38. The jamb base has side walls 24, 26 which, together with front wall 28, define rearwardly-open rear cavity 30. Pultruded fiberglass structure 22 is mounted on a wood jamb substrate 44 of e.g. an in-swing entry door frame. A mounting fin kerf 110 is located on the surface 112 of the nosing which faces sheathing 96. A deflectable mounting fin 80 is mounted in kerf 110. Mounting fin 80 can rotate in kerf 110, to a position relatively downwardly against substrate 44, and relatively upwardly toward and against surface 112 of the nosing, e.g. generally parallel with surface 112. Kerf 110 is also compatible with receiving a flexing polymeric mounting fin which flexes about an elongate pivot locus as taught in e.g. U.S. Pat. No. 4,821,472 Tix. The embodiment of FIG. 8 thus provides for delectability of the mounting fin, thus limiting the space required for storage and/or transport of the corresponding jamb assemblies. Surface 112 of the nosing further has a screw receiver 154. Screw receiver 154 receives a screw as the nosing of either a left or right side member 14, 16 is joined to the nosing of the top member 12.

Still referring to FIG. 8, substrate 44 has a latch-side abutment surface 115 against which the in-swing door is closed. A deflectable weather seal 114 is received in a slot 116 on latch-side abutment surface 117.

Figure 9:
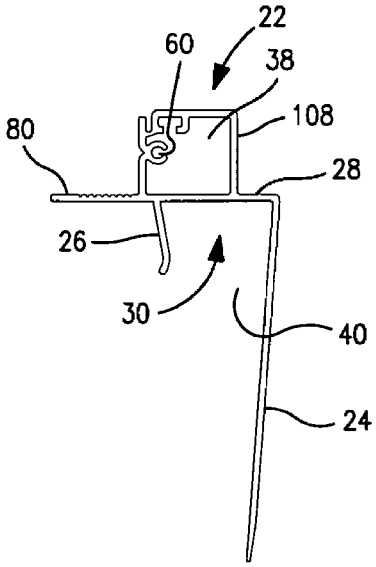
FIG. 9 is an end view of another embodiment of pultruded cladding of the invention, for installation on a wood or other jamb insert.

FIG. 9 shows an end view of another embodiment of pultruded fiberglass structures 22 having an integral and narrower fully enclosed nosing 108 as in FIG. 8, as well as a mounting fin 80 which, unlike in FIG. 8, is an integral member of the pultruded structure 22. Screw receiving channel 60 is located in the nosing. Rearwardly-disposed, and rearwardly-opening cavity 30 is adapted to receive a substrate 44 (not shown) between side walls 24, 26, and against end wall 28. In general, the embodiment of FIG. 9 is similar to that of FIG. 8 except for the narrower nosing, and the integral and relatively rigid mounting fin 80.

Figure 10:
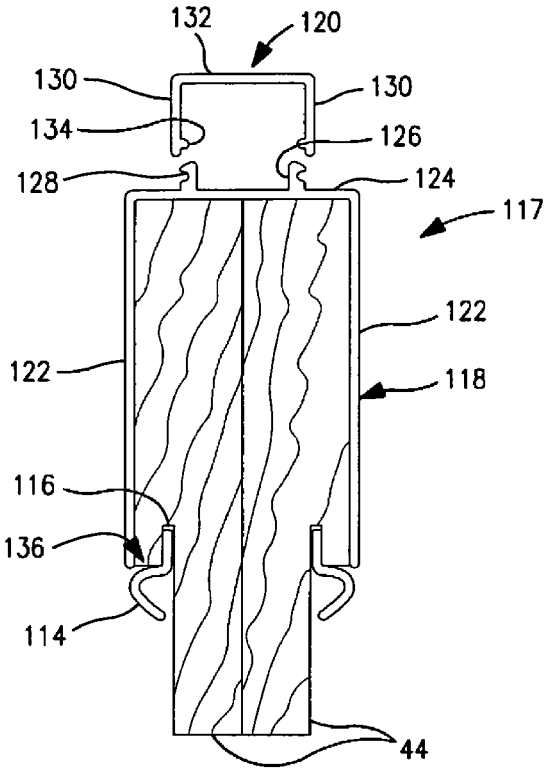
FIG. 10 illustrates an end view of a pultruded mullion cover and pultruded mullion nosing of the invention, installed on wood mullion substrates.

FIG. 10 shows the principles of using fiberglass pultrusions to cover one or more wood substrate 44 (two substrates 44 are shown), in a mullion assembly 117 which is located e.g. next to a door frame, or as an integral member of a door frame assembly. Mullion cover 117 includes an elongate pultruded base structure 118 and an elongate pultruded mullion nosing 120. The pultruded base structure 118 has opposing side walls 122, and an end wall 124 extending between and connecting side walls 122. Locking studs 126 extend from end wall 124 and bear locking loci 128. Nosing 120 has first and second legs 130 extending from outer wall 132 toward studs 126. Legs 130 bear cooperating locking loci 134 which lock to locking loci 128 on studs 126.

In the embodiment illustrated in FIG. 10, each substrate has a latch-side abutment surface 136 at an inwardly-facing side of the substrate. A slot 116 in a latch-side abutment surface 136 receives a weather strip 114 against which an in-swing door can be closed. Thus, mullion assembly 117 illustrates the use of pultruded cover structures in a mullion which extends between two side-by-side in-swing entry doors, and wherein nosing 120 is centered in the mullion assembly.

As illustrated in FIG. 10, side and end walls 122, 124 cover substantially the entirety of substrates 44, including substantially the entirety of the lengths of the substrates, which are exposed to ambient weather when e.g. an entry door slab is closed against seal 114 at latch-side abutment surface 116. Pultruded base structure 118 is mounted to substrates 44 by a plurality of screws 138 or other fasteners which extend through base structure 118 and into the substrates at spaced locations along the length of the mullion assembly. Nosing 120 snap locks onto legs 126 of base structure 118, thus to provide a desired finished trim appearance on the mullion.

Figure 11:
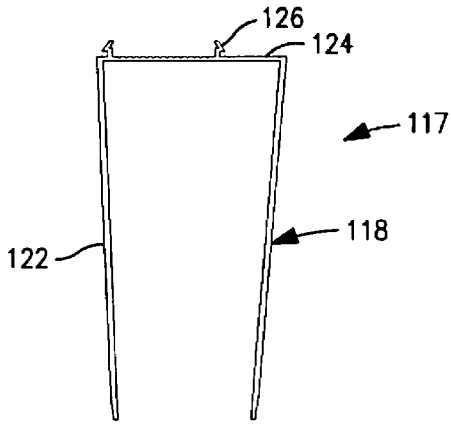
FIG. 11 shows an end view of another embodiment of a pultruded mullion cover of the invention.

FIG. 11 shows a pultruded mullion cover base structure 118 similar to the base structure of FIG. 10, but where studs 126 are off-set from the center of end wall 124, thus to provide a side-biased nosing mounting locus. Other than the stud off-set, the mullion cover of FIG. 11 is the same as the mullion cover of FIG. 10, and can receive and lock the same nosing as in FIG. 10.

To this point, the invention has contemplated fiber-reinforced pultruded polymeric structures as being used to cover an e.g. solid substrate such as a wood substrate or an extruded polymeric substrate, where the substrate provides a substantial portion of the structural strength of the resultant door jamb, as a member of a door frame, and wherein the substrate provides a substantial portion of the structural strength of the resultant door frame. FIGS. 12-13 and 16-19 illustrate the use of fiber-reinforced pultruded polymeric structures as the entirety of the structural portion of such door frame members, e.g. wherein no wood or other substrate is used to achieve completion of assembly of the jamb assembly or completion of assembly of a door frame which is made from a plurality of such jamb assemblies, or to achieve suitable strength and/or rigidity in such door frame. Namely, the pultruded structures illustrated in FIGS. 12, 13, and 16-19 provide all of the structural elements needed to provide the top 12 and side 14, 16 members of a door frame or door frame kit of the invention, allowing for addition of optional generally non-structural elements such as gussets, nail fins, weather strip, and the like. However, the pultrusions provide substantially all of the structural strength needed in the frame assemblies which comprise the top and side members.

Figure 15:
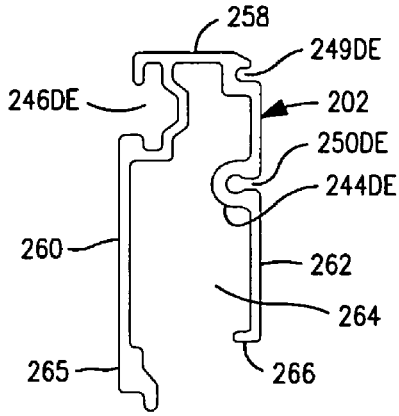
FIG. 15 illustrates an end view of a pultruded depth extender of the invention e.g. as used in the assemblies of FIGS. 12 and 13.
Figure 16:
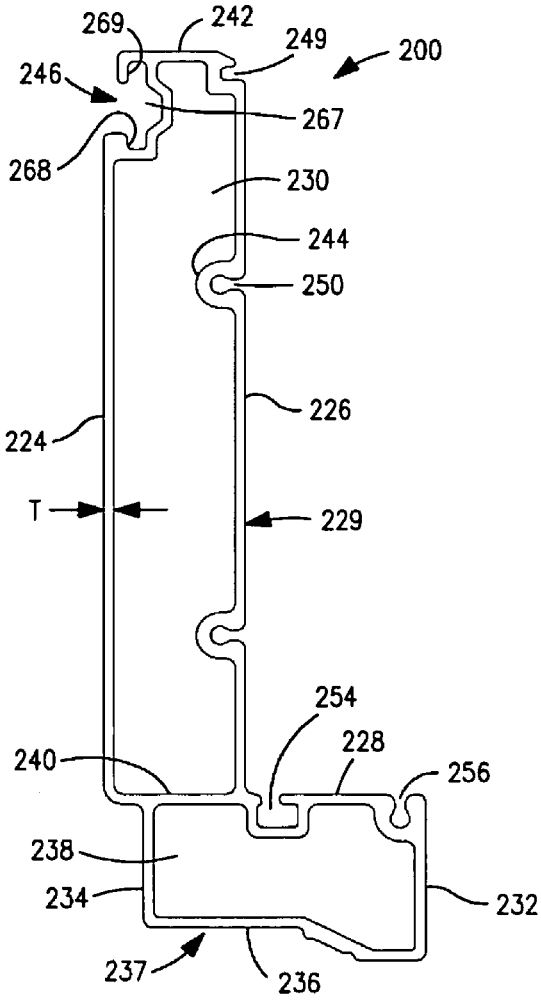
FIG. 16 illustrates an end view of a pultruded garage door frame jamb base as in FIGS. 12 and 13 without the depth extender.

FIGS. 12, 13, 16, and 18 collectively illustrate fiberglass pultruded jamb bases which can be used as the base to which any accessories can be mounted in assembling a top member 12 or side member 14, 16 of a door frame. FIG. 16 shows an end view of only the pultruded jamb base 200, with an integral brickmold nosing. FIG. 17 shows a pultruded jamb base as in FIG. 16 but with a narrower, intermediate-width, nosing. FIG. 18 shows an end view of a jamb base 204 with brickmold nosing, as in FIG. 16, adapted to receive an in-swing e.g. entry door. FIG. 15 shows an end view of an elongate depth extender 202 which can be mounted to the jamb base 200 of FIG. 16 to extend the depth of the jamb assembly, for use in buildings which have a relatively greater wall thickness. FIG.

19 shows an end view of a jamb extender 206 which can be mounted to the jamb base 204 of FIG. 18 to extend the depth of the jamb assembly, for use in buildings which have a relatively greater wall thickness.

Figure 12:
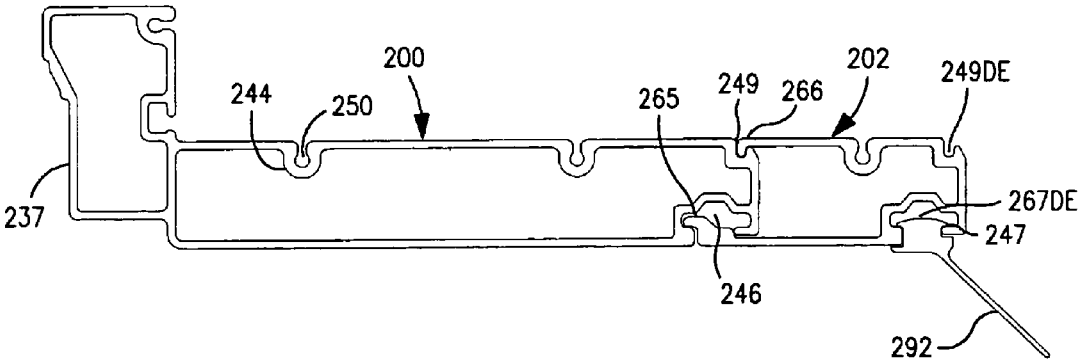
FIG. 12 shows an end view of a pultruded garage door frame assembly of the invention, including a frame-depth extender.
Figure 13:
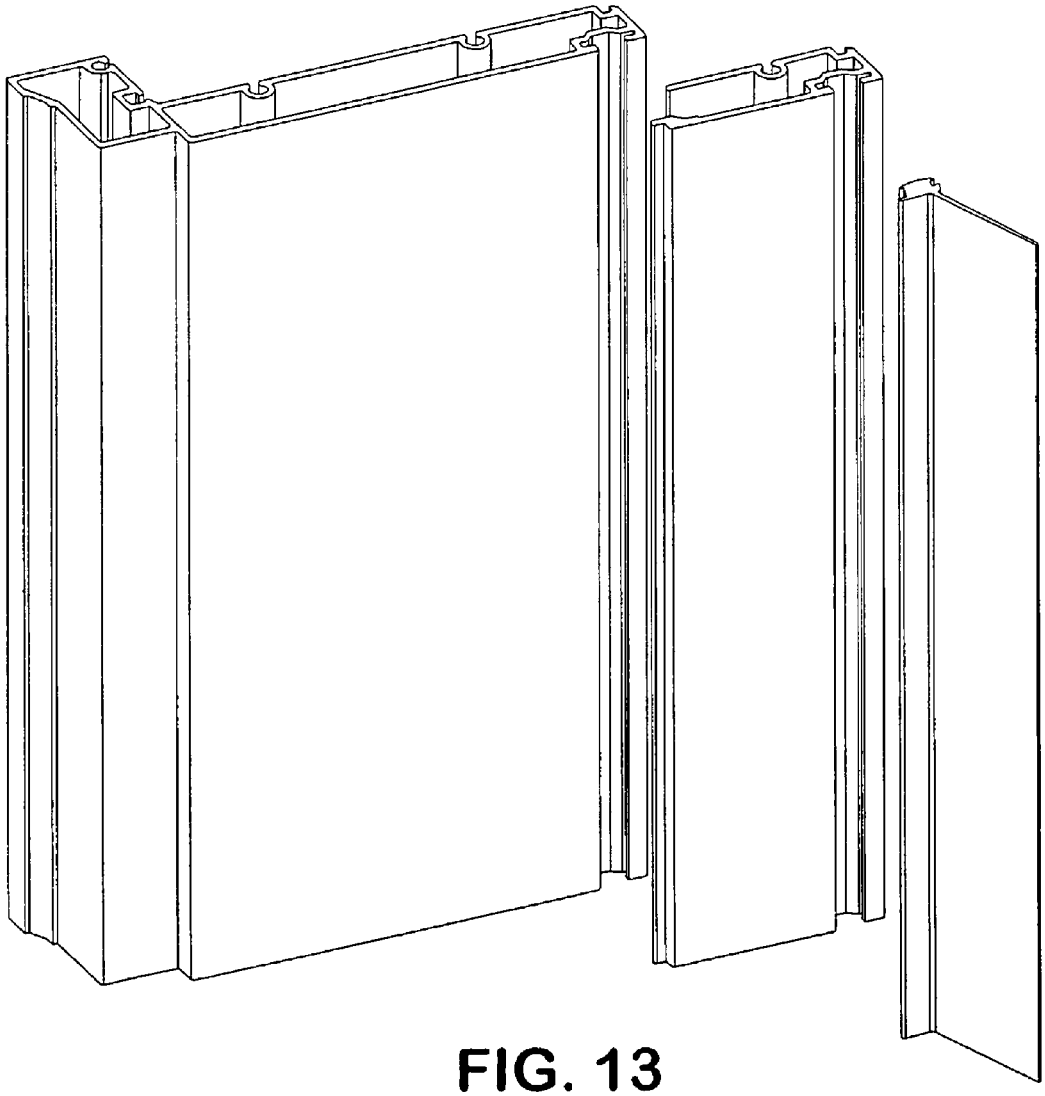
FIG. 13 shows a perspective exploded view of the pultruded garage door frame assembly embodiment of FIG. 12.
Figure 14:
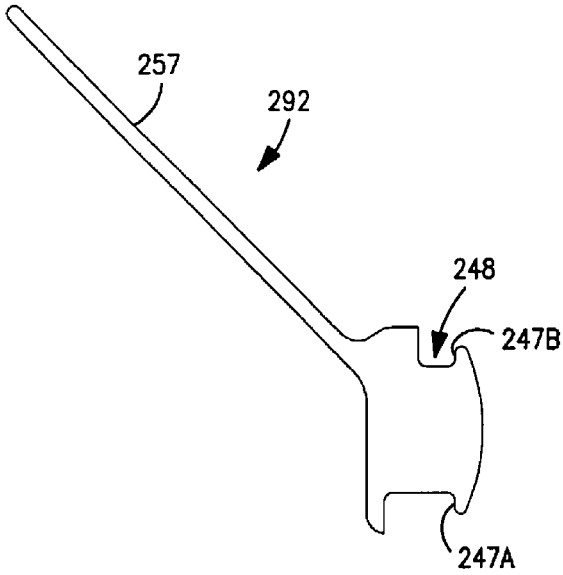
FIG. 14 illustrates an end view of a flexible polymeric weather strip profile of the invention which can be used in e.g. the embodiments of FIGS. 12 and 13, as well as in the following FIGS. 15-17.

FIG. 14 illustrates an end view of a seal strip 292 which can be mounted in either jamb base 200 or jamb extender 202. FIG. 12 illustrates an end view of jamb extender 202 mounted to jamb base 200, and wherein seal strip 292 is mounted to the jamb extender. FIG. 13 shows the jamb base 200, the jamb extender 202, and the seal strip, of FIGS. 14, 15, and 16, and the assembly of FIG. 12, in an exploded pictorial view.

Turning now specifically to FIG. 16, the elongate pultruded structure 200 has a closed-perimeter profile. The closed perimeter profile defines a closed-perimeter jamb block 229 extending about an inwardly-disposed cavity 230 and a closed-perimeter brickmold nosing block 237 extending about outwardly-disposed cavity 238. A common wall 240 extends across the closed-perimeter profile between inwardly-disposed cavity 230 and outwardly-disposed cavity 238, as part of both jamb block 229 and nosing block 237.

Inwardly-disposed jamb block 229 has an outer end defined by common wall 240, an inner end defined by rear wall 242, and sides defined by side walls 224 and 226, all participating in the definition of inwardly-disposed cavity 230. One or more support webs can extend across cavity 230 similar to support webs 66 in FIG. 4. As shown, first and second inwardly-expressed support ribs 244 extend into cavity 230 from the general surface of side wall 226 and extend the length of structure 200. Fewer, or more, ribs 244 can be used in order to achieve the desired degree of stiffness, rigidity about cavity 230. Support ribs 244 reinforce side wall 226, and thus reinforce jamb block 229. The open, necked cavities 250 formed by ribs 244 function as screw receivers used to mount top member 12 to side members 14, 16. A seal strip receiving cavity 246 is integral with the overall perimeter profile of jamb block 229 on side wall 224 adjacent rear wall 242. Lock receptor 249 is disposed on side wall 226 adjacent rear wall 242.

Referring to FIG. 14, seal strip 292 has a mounting stud 248, and a fin 257 extending from stud 248. Stud 248 has a main stud body, and ears 247 extending from the main stud body. Stud 248 is cooperatively sized and configured, and the material of stud 248, including ears 247, is sufficiently flexible, to mount seal strip 292 in mounting cavity 246, with the main body of the stud received in the relatively greater depth main chamber 267 of cavity 246 and with ears 247 of stud 248 registered under relatively lesser thickness/depth locking chambers 268, 269 which extend outwardly from the main body 267. Fin 257 is sufficiently flexible to serve as a weather seal member when interfacing with the body of a door which is received inside a frame which is made with jamb 200.

Returning to FIG. 16, outwardly-disposed nosing block 237 has an inner end defined by common wall 240, an outer end defined by front wall 236, and sides defined by side walls 232, 234, all participating in the definition of outwardly-disposed cavity 238. The overall configuration of nosing block 237 is illustrated as that of a brickmold nosing, integral with the jamb block as part of the body of jamb 200. Thus the overall profile of nosing block 237 is in the configuration of a brickmold nosing. The outer appearances of side walls 232 and 234 are configured like conventional brickmold nosing side walls. The outer appearance of front wall 236 is configured like a conventional brickmold nosing front wall. The end wall 228 of brickmold nosing block 237 is generally similar to a conventional brickmold nosing end wall. End wall 228 has mounting fin kerf 254 and screw receiver 256. Kerf 254 is compatible with receiving either a flexing polymeric mounting fin as taught in e.g. U.S. Pat. No. 4,821,472 Tix, or a deflectable mounting fin such as the aluminum mounting fin 80 illustrated in FIG. 8.

Referring to FIG. 15, elongate pultruded depth extender 202 has a rear wall 258, and first and second side walls 260 and 262 which extend generally about a frontwardly-opening cavity 264. A single reinforcing rib 244DE, and corresponding screw receiver 250DE, are disposed on side wall 262. A strip mounting cavity 246DE is disposed on side wall 260 adjacent rear wall 258. The front end of elongate side wall 260 terminates in an in-turned mounting finger strip 265 which is sized and configured to mount in strip mounting cavity 246. The front end of side wall 262 terminates in an in-turned stud strip 266 which is sized and configured to mount in elongate lock receptor 249. While pultruded depth extender 202 is sufficiently stiff and rigid to provide satisfactory dimensional stability to the door frame, the front ends of side walls 260 and 262 are sufficiently deflectable that finger strip 265 and stud strip 266 can be snap-locked into strip mounting cavity 246 and lock strip receptor 249.

In such mounting, and starting with the relative orientations shown in the combination of FIGS. 15 and 16, depth extender 202 is first brought adjacent jamb base 200. Extender 202 is rotated counter-clockwise bringing side wall 260 closer to side wall 224, and finger strip 265 is inserted into cavity 246, and under locking chamber 268. While maintaining finger strip 265 registered under locking chamber 268, extender 202 is rotated clockwise until stud strip 266 snap locks in strip receptor 249. Upon completion of such snap-locking, depth extender 202 is locked to jamb base 200 as illustrated in FIG. 12.

Depth extender 202 is used only as necessary to match the depth of the jamb to the depth of the wall of the building into which the door frame is being installed. Thus, for a relatively thinner wall, no depth extender is net needed. For a relatively thicker wall, jamb extender 202 is used as shown in FIG. 12. If and as still-additional depth is needed, one or more additional depth extenders can be snap-locked to the assembly as at cavity 246DE and receptor 249DE.

Where the desired depth of the jamb has been achieved, seal strip 292 is mounted to depth extender 202 by inserting stud 248 on the seal strip into the distal one, from wall 240, of cavities 246 and 246DE, with ears 247 under locking chambers 268, 269, again as illustrated in FIG. 12. The weather seal 292 cooperates with the door and door frame to provide a weather seal in the same manner as is shown in FIG. 3.

Where depth extender 202 is not used, seal strip 292 is mounted to jamb base 200 at cavity 246 instead of at cavity 246DE.

As is seen in FIGS. 12-16, the pultruded jamb structure 200, optionally supplemented by depth extender 202, provides the entirety of the structural body of the jamb, whereby no reinforcing insert, such as substrate 44 is needed. To that end, the inwardly-disposed ends of cavities 230, 238, and 264 are all closed, e.g. by walls 240, 242, and 258 respectively. Accordingly, the subject jambs, and door frames made with such jambs, are free from any deleterious effects which accompany wood jambs and wood jamb inserts.

Where structural inserts are desired, such as in the embodiments of FIGS. 1-3, 8, and 10, non-cellulosic inserts are contemplated. For example, polymeric inserts, such as solid or high-density cellular polyolefinic inserts, for example and without limitation polyethylene inserts, are not subject to deterioration as a result of being exposed to water. Accordingly, extruded polyethylene inserts, either solid inserts or high-density foam inserts having density of at least 24 pounds per cubic foot, are contemplated as extending the full length of the pultruded structure 22 as an alternative to wood inserts of the invention.

FIGS. 18 and 19 show the principles of pultruded structures described herein applied to frames for in-swing entry doors. FIG. 18 illustrates a jamb base 204 for such entry door frame. FIG. 19 illustrates a depth extender 206 for such entry door frame. As illustrated, jamb base 204 is in all respects the same as jamb base 200 of FIG. 16, except for the provision of a latch-side abutment surface 270, and the structure of cavity 246. Latch-side abutment surface 270 provides a surface against which an in-swing door can close on the latch side of the frame, as in the embodiments of FIG. 8. The rear end of cavity 246 has been modified from FIG. 16 to provide for the final closure swing of an in-swing door 272 as indicated by arrows 274. The departure from FIG. 8 is that jamb base 204 in FIG. 18 is a stand-alone, unreinforced pultruded structure, not subject to insertion of a reinforcing substrate 44. The departure from FIGS. 15-16 is that jamb base 24 is adapted for use with an in-swing door slab compared to a vertically travelling, up or down, garage door which is contemplated in the embodiments of FIGS. 15-16.

Referring to FIG. 18, inwardly-disposed jamb block 229 of jamb base 204 has an outer end defined by common wall 240, an inner end defined by rear wall 242, and sides defined by side walls 224 and 226, all participating in the definition of inwardly-disposed cavity 230. One or more support webs can extend across cavity 230 similar to support webs 66 in FIG. 4. As shown, first and second inwardly-expressed support ribs 244 extend into cavity 230 from the general surface of side wall 226 and extend the length of structure 204. Fewer, or more, ribs 244 can be used in order to achieve the desired degree of stiffness, rigidity about cavity 230. Support ribs 244 reinforce side wall 226, and thus reinforce jamb block 229. The open, necked cavities 250 formed by ribs 244 function as screw receivers used to mount top member 12 to side members 14, 16. A strip receiving cavity 246 is integral with the overall perimeter profile of jamb block 229 on side wall 224 adjacent, but spaced from, rear wall 242. Lock receptor 249 is disposed on side wall 226 adjacent rear wall 242.

A weather seal strip 114 as in FIG. 8 is received in cavity 246.

Outwardly-disposed nosing block 237 has an inner end defined by common wall 240, an outer end defined by front wall 236, and sides defined by side walls 232, 234, all participating in the definition of outwardly-disposed cavity 238. The overall configuration of nosing block 237 is illustrated as that of a brickmold nosing, integral with the jamb block as part of the body of jamb 204. Thus the overall profile of nosing block 237 is in the configuration of a brickmold nosing. The outer appearances of side walls 232 and 234 are configured like conventional brickmold side walls. The outer appearance of front wall 236 is configured like a conventional brickmold front wall. The end wall 228 of brickmold nosing 237 is generally similar to a conventional brickmold end wall. End wall 228 has mounting fin kerf 254 and screw receiver 256. Kerf 254 is compatible with receiving either a flexing polymeric mounting fin as taught in e.g. U.S. Pat. No. 4,821,472 Tix, or a deflectable mounting fin such as the aluminum mounting fin 80 illustrated in FIG. 8, which deflects in its entirety, including inside kerf 256, as the fin moves toward and away from the jamb block.

Referring to FIG. 19, pultruded depth extender 206 has a rear wall 258, and first and second side walls 260 and 262 which extend generally about a frontwardly-opening cavity 264. A single reinforcing rib 244DE, and corresponding screw recesses 250DE, is disposed on side wall 262. A strip mounting cavity 246DE is disposed on side wall 260 generally toward, but displaced from, rear wall 258. The front end of side wall 260 terminates in an in-turned mounting finger 265 which is sized and configured to mount in strip mounting cavity 246. The front end of side wall 262 terminates in an in-turned stud 266 which is sized and configured to mount in lock receptor 249. While the pultruded depth extender 206 is sufficiently stiff and rigid to provide satisfactory dimensional stability to the door frame, the front ends of side walls 260 and 262 are sufficiently deflectable that finger 265 and stud 266 can be snap-locked into cavity 246 and lock receptor 249.

In such mounting, and starting with the relative orientations shown in the combination of FIGS. 18 and 19, depth extender 206 is first brought adjacent jamb base 204. Extender 206 is rotated counter-clockwise, bringing side wall 260 closer to side wall 224, and finger 265 is inserted into cavity 246DE. While maintaining finger 265 registered in cavity 246DE, extender 206 is rotated clockwise until stud 266 snap locks into receptor 249. Upon completion of such snap-locking, depth extender 206 is locked to jamb base 204, with a corner recess 276 adjacent mounting cavity 246DE on the inner surface of side wall 260, adjacent mounting cavity 246DE, in stressed abutting engagement the outer surface of jamb base 200 at at least one of side wall 224 and rear wall 242, optionally in stressed engagement with both side wall 224 and rear wall 242, at the corner where side wall 224 and rear wall 242 meet. Thus, depth extender 206 is held in a 3-point lock wherein finger 265 is leveraged against both side wall 224 and/or rear wall 242 at corner recess 276, and against the snap-lock of stud 266 in receptor 249.

Depth extender 206 is used only as necessary to match the depth of the jamb to the depth of the wall of the building into which the jamb is being installed. Thus, for a relatively thinner wall, depth extender 206 is not needed. For a relatively thicker wall, depth extender 206 is used. If and as still-additional depth is needed, one or more additional depth extenders can be snap-locked to the assembly as at cavity 246DE.

Where the desired depth of the jamb has been achieved, seal strip 114 is mounted to depth extender 206 by the seal strip anchor 278 into cavity 246DE on the depth extender. The weather seal 114 cooperates with the door and door frame in providing a weather sealing feature.

Where depth extender 206 is not used, seal strip 114 is similarly mounted to jamb base 204 at cavity 246, as illustrated.

As is seen in FIGS. 12-16, the pultruded jamb structure 200, 204 optionally supplemented by extender 202, 206 provides the entirety of the structural body of the jamb, whereby no reinforcing insert, such as substrate 44 is needed. To that end, the inwardly-disposed ends of cavities 230, 238, and 264 are all closed, e.g. by walls 240, 242, and 258 respectively. Accordingly, the subject jambs, and door frames made with such jambs, are free from any deleterious effects which accompany wood jambs and wood jamb inserts.

Figure 20:
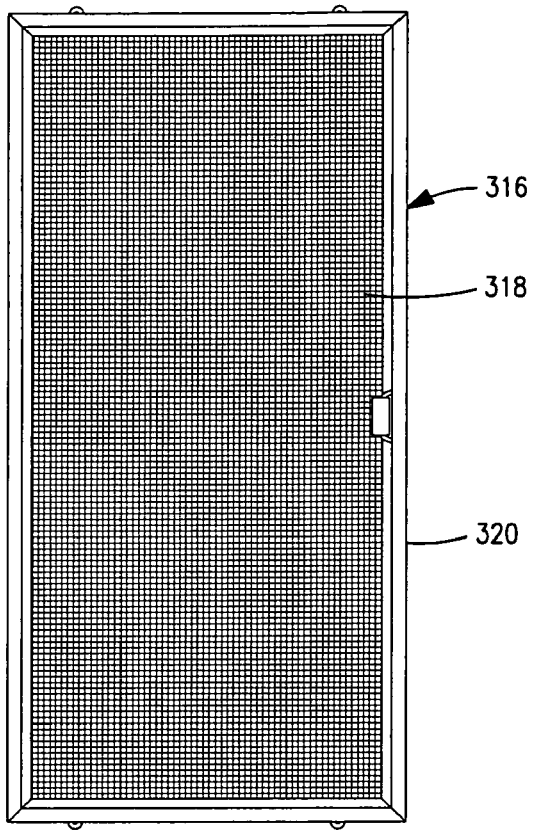
FIG. 20 shows a side elevation view of a patio door screen of the invention made with pultruded frame structures.
Figure 21:
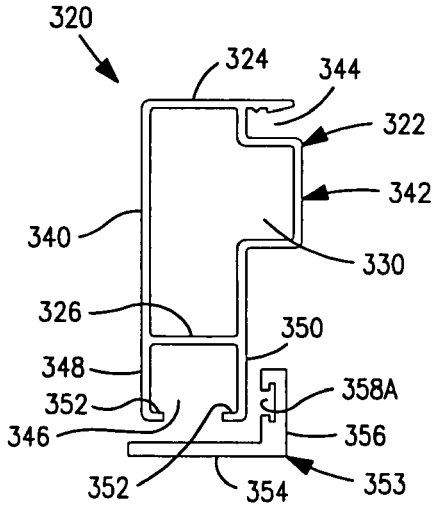
FIGS. 21 and 22 show cross-section views of pultruded frame members of the screen door of FIG. 20.
Figure 22:
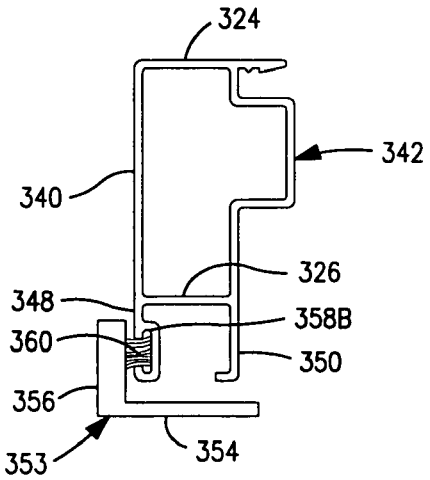

Referring now to FIGS. 20-22, a patio door screen door frame using pultruded frame elements of the invention is disclosed. The patio door, in general, includes a door frame 353, first and second sliding framed glass doors, and a framed sliding screen door 316 having a screen 318 enclosed within an elongate fiber-reinforced pultruded polymeric patio screen door frame 320. The pultruded patio screen door frame is adapted to be used as a door element of the side-by-side sliding patio door which separates the enclosed space in a building from the ambient outdoor environment. The door frame has an elongate top frame member, an elongate bottom frame member, and elongate first and second side frame members extending between the top and bottom frame members. The top, bottom, and side frame members define the inwardly disposed opening through the frame, which receives the screen proper 318 which spans and closes off the opening.

Each of the top, bottom, and side frame members, shown in cross-section in FIGS. 21 and 22, has a relatively inwardly disposed, closed frame block 322 which defines a first closed cavity 330, and an inner wall 324 disposed toward the frame opening, an outer wall 326 disposed away from the frame opening, a first side wall 342 disposed in a direction inwardly into the enclosed space of the building, a second side wall 340 disposed in a direction outwardly away from the enclosed space of the building. The first and second side walls connect the inner and outer walls to each other. Side wall 342 includes an elongate receptacle 344 which extends along the length of the respective frame member and receives and holds the screening 318 therein as the screening spans the inwardly disposed opening in the frame.

Each of the frame members further defines an outwardly disposed, outwardly opening cavity 346 extending from the outer wall 326 outwardly of the frame opening to a distal end of the outwardly disposed cavity. The outwardly disposed cavity is defined by an inner wall 326 in common with outer wall 326 of inwardly disposed frame block 322, a third side wall 348 extending from inner wall 326 and away from second side wall 340, and a fourth side wall 350 extending from inner wall 326 and away from first side wall 342.

Door frame 353 includes an elongate fiber-reinforced pultruded polymeric jamb adapted to cooperate with the pultruded patio screen door frame in holding the patio screen door frame into assembly with the other framed elements of the sliding patio door. The pultruded jamb comprises an elongate outer plate 354 and an elongate side plate 356 joined to the outer plate. The side plate is in face-to-face relationship with one of the third and fourth side walls of cavity 346. At least one of the side plate 356 and the third 348 or fourth 350 side wall comprises a pile receptacle 358A, 358B which receives a pile strip 360 which serves as a thermal barrier between the sliding surfaces of the side plate and the respective third or fourth side wall.

Figure 23:
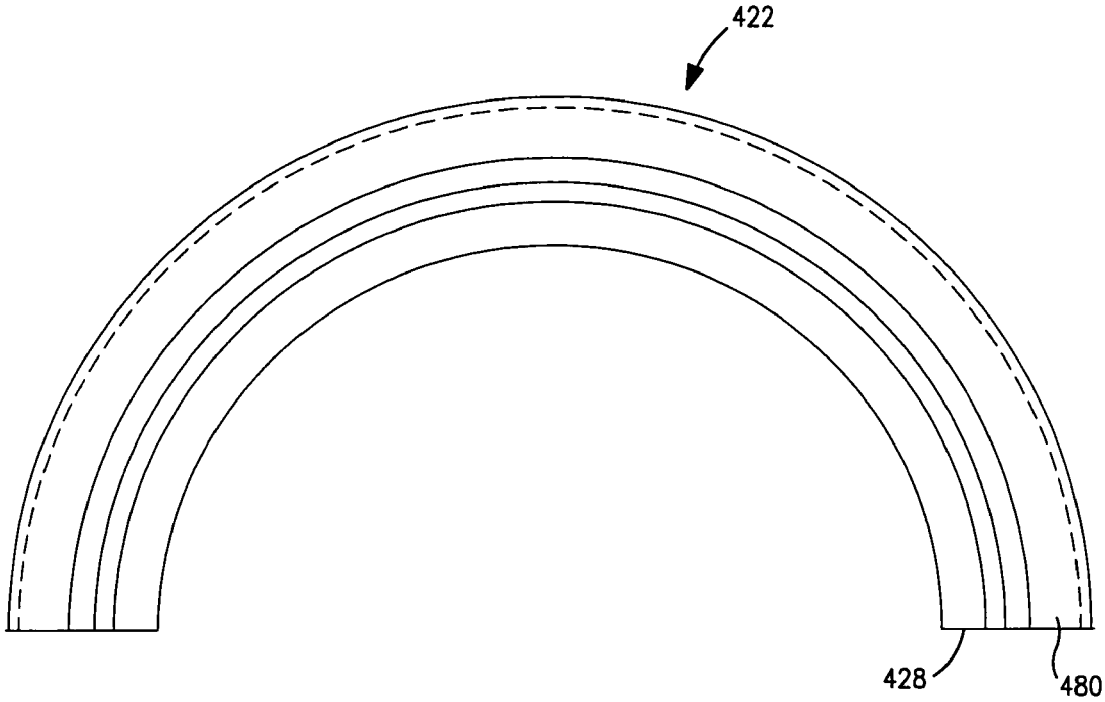
FIGS. 23 and 24 show front elevation and cross-section views of a molded curved fiber reinforced polymeric top jamb covering structure of the invention.
Figure 24:
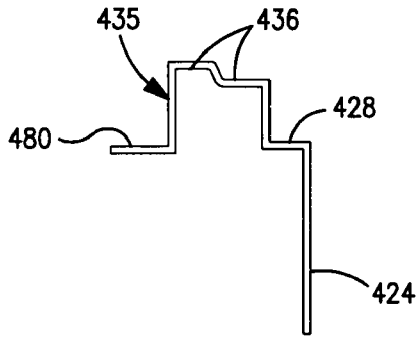

FIGS. 23 and 24 illustrate fiber reinforced polymeric covers for use in top jamb members which are curved, arcuate. FIG. 23 shows a front elevation view of a molded fiberglass reinforced polymeric jamb cover 422 in ½ round configuration, which is used to cover ½ round top jamb substrates 44. Jamb cover 422 is made in a polymer molding process wherein the fiberglass reinforcing material is placed and arranged in an open mold. The mold is closed, and then polymer is infused into the mold, optionally with vacuum assist, filling the mold and saturating the fiberglass in the mold. The polymer is cured. The mold is then opened and the resulting cover is removed from the mold and trimmed as necessary.

As illustrated in FIG. 24, jamb cover 422 has a side wall 424 which covers the surface of the substrate which faces toward the doorway opening. End wall 428 abuts the outer surface of the substrate adjacent side wall 422. Nosing structure 435 reflects the general outer profile of a brickmold nosing in its stepped front wall 436. Mounting fin 480 extends outwardly from nosing structure 480 and serves for mounting the jamb cover 422 to sheathing or other underlying layer of the wall structure of the underlying building. Jamb cover 422 extends as a single-piece molding from side wall 424 to mounting fin 480.

Figure 25:
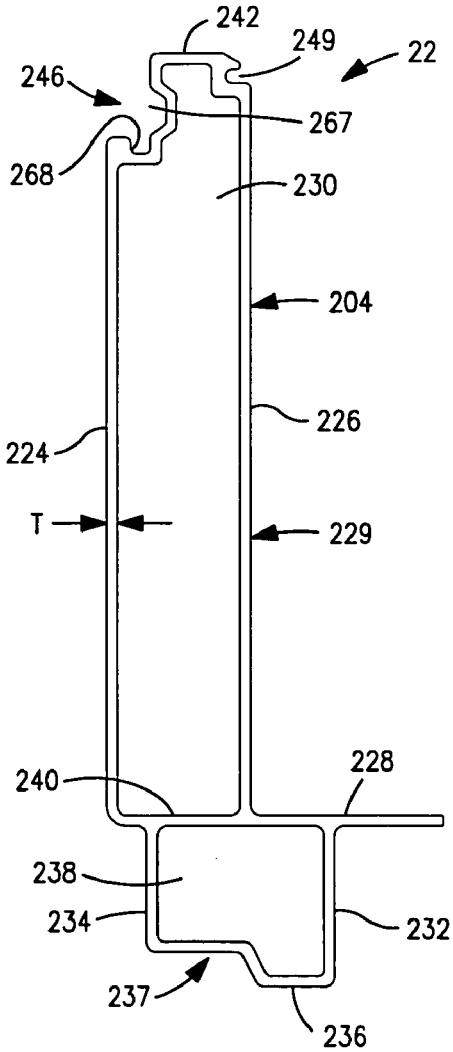

FIG. 25 illustrates the fiber reinforced polymeric ½ round profile in a closed-perimeter structure 22 such that the molded structure 22 functions as the entire structural element of the top frame member, in the same way that jamb base 204 of FIG. 18 functions as the frame structure, namely without the inclusion of a frame substrate. The salient differences between the structure profiles in FIGS. 25 and 18 are as follows:

(a) The profile in FIG. 25 is arcuate along its length while the profile of FIG. 18 is straight along its length.

(b) The nosing blocks 237 represent different profile configurations.

(c) The structure of FIG. 18 is a continuously pultruded structure while the structure of FIG. 25 is molded in a batch molding process where the mold is closed for completion of infusion of the resin into the mold, and curing, and is opened to remove the molded part.

(d) The open-necked cavities 250 of FIG. 18 have been deleted in FIG. 25.

Thus, the jamb profile of FIG. 25 defines a closed-perimeter jamb block 229 extending about inwardly-disposed cavity 230, and closed-perimeter nosing block 237 extending about outwardly-disposed cavity 238. Common wall 240 extends across the closed perimeter of the profile between inwardly-disposed cavity 230 and outwardly-disposed cavity 238, as part of both jamb block 229 and nosing block 237.

Referring to FIG. 25, arcuate molded polymeric jamb structure 22 includes inwardly-disposed jamb block 229 of jamb base 204 and nosing block 237. Jamb base 204 has an outer end defined by common wall 240, an inner end defined by rear wall 242, and sides defined by side walls 224 and 226, all participating in the definition of inwardly-disposed cavity 230. A strip receiving cavity 246 is integral with the overall perimeter profile of jamb block 229 on side wall 224 adjacent, but spaced from, rear wall 242. Lock receptor 249 is disposed on side wall 226 adjacent rear wall 242.

A weather seal strip 114 as in FIG. 8 can be received in cavity 246.

Outwardly-disposed nosing block 237 has an inner end defined by common wall 240, an outer end defined by front wall 236, and sides defined by side walls 232, 234, all participating in the definition of outwardly-disposed cavity 238. The overall configuration of nosing block 237 is illustrated as that of an intermediate-width nosing, integral with the jamb block as part of the body of jamb 204, and reflects generally the same profile as that shown in FIGS. 23 and 24. The end wall 228 of nosing 237 includes an integral mounting fin 80 as illustrated in FIG. 9. The nosing can as well have a kerf in end wall 228 for receiving a mounting fin therein.

Figure 26:
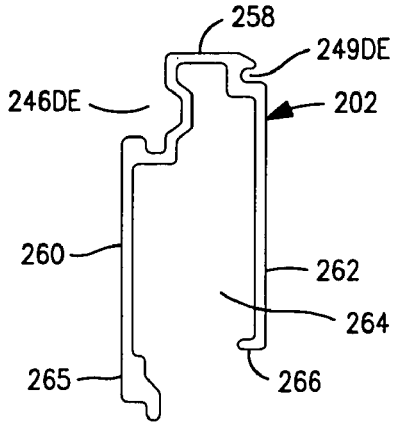
FIGS. 25 and 26 show cross-section views of a molded fiber reinforced polymeric jamb base and depth extender as in FIGS. 18-19, having the ½ round curvature seen in FIG. 23.

Referring to FIG. 26, arcuate molded polymeric depth extender 206 has a rear wall 258, and first and second side walls 260 and 262 which extend generally about a frontwardly-opening cavity 264. Strip mounting cavity 246DE is disposed on side wall 260 generally toward, but displaced from, rear wall 258. The front end of side wall 260 terminates in an in-turned mounting finger 265 which is sized and configured to mount in strip mounting cavity 246. The front end of side wall 262 terminates in an in-turned stud 266 which is sized and configured to mount in lock receptor 249. While the pultruded depth extender 206 is sufficiently stiff and rigid to provide satisfactory dimensional stability to the door frame, the front ends of side walls 260 and 262 are sufficiently deflectable that finger 265 and stud 266 can be snap-locked into cavity 246 and lock receptor 249.

Depth extender 206 is used only as necessary to match the depth of the jamb to the depth of the wall of the building into which the jamb is being installed. Thus, for a relatively thinner wall, depth extender 206 is not needed. For a relatively thicker wall, depth extender 206 is used. If and as still-additional depth is needed, one or more additional depth extenders can be snap-locked to the assembly as at cavity 246DE.

Where the desired depth of the jamb has been achieved, a seal strip 114 is mounted to depth extender 206 by the seal strip anchor 278 (FIG. 18) into cavity 246DE on the depth extender. The weather seal 114 cooperates with the door and door frame in providing a weather sealing feature.

Where depth extender 206 is not used, seal strip 114 is similarly mounted to jamb base 204 at cavity 246, again as illustrated in FIG. 18.

As referred to herein, pultrusion, pultruded structures, and the like, refers to products and processes as commonly recognized in the industry. Thus, a pultruded product or structure or process includes reinforcing fibers embedded in a generally saturating amount of a curable and/or cured or thermoplastic resin, and is included in the general class of materials known as fiber reinforced polymeric structures. Pultrusion is a process which can be used to make continuous lengths of fiber reinforced polymeric products. The starting materials are liquid polymeric resins and fiber structures which reinforce the polymeric resins. As a general statement, the fibrous reinforcing structure is pulled, in a continuous process, through a forming die. In the process, the fibrous structure is impregnated with the polymeric resin, the overall structure is formed into a desired profile, and the resin/fiber composite is "set/cured" in the desired profile by the application of heat to the resin/fiber composite.

More specifically, the fiber is drawn through a resin impregnator where the fiber is saturated with resin. The resin/fiber composite passes from the impregnator to a pre-former which forms the composite into the desired profile. The composite is then passed to a heating die where the resin is cured while the die maintains the composite in the desired profile. The cured product then exits the die and moves to the puller which applies a pulling force to the cured product, which pull passes through the reinforcing fibers back to the creels which feed the fiber materials to the process—thus the moniker "pultrusion", which pulls product through the forming die and thus through the forming system, compared to "extrusion" which pushes softened e.g. polymeric material or metal through a forming die. On exiting the puller, the product can be cut to length, or otherwise converted to any desired length, width, or other desired form or shape.

For example, glass or other reinforcing fibers are impregnated with resin and pulled through a former and a heated die. The former orients the fibers according to the specified profile such that the fibers are properly positioned in the die, thus to ensure that the pultruded product has consistent reinforcement properties, as desired, across the profile of the pultruded structure. The resulting pultruded structure is continuously pulled from the heated die by the puller. The puller can be a clamp and stroke action from a reciprocating puller, or a consistently-pulling closed-track puller, also known as a caterpillar puller.

Reinforcing fibers used in pultrusions of the invention can be, for example and without limitation, glass fiber, carbon fiber, kevlar fiber, and/or other organic and inorganic filaments and fibers. Reinforcement fibers can take the forms of filament and strand bundles, called rovings. The fibers can also take the forms of yarns, texturized yarns, chopped strand mats, continuous strand mats, knitted mats, woven mats, surfacing veils, and combinations of rovings, yarns, mats, and veils, for example a package of uniform fiberglass reinforcements and continuous filament rovings.

Resins used in pultrusions of the invention can be thermosetting resins such as, without limitation, polyesters e.g. in a styrene solution, or polyurethanes, phenolics, epoxides, thermosetting mixtures and other thermosetting resins. Other resins used in pultrusion can be thermoplastic resins such as polyurethanes, acrylics, polyethylenes, and other thermoplastic resins. Resin used in pultrusion can also be thermoplastic resins which are embedded in fiber structures which are fed into the pultrusion process, and wherein the resins melt inside the pultrusion die.

Resin mixtures in pultrusion can also contain organic, polymeric, and/or inorganic additives provided to achieve certain property modifications such as shrink control or limitation, mold lubrication, coloring, filling, and other specified property features.

Pultruded fiber-reinforced structures are desired both for their strength and their thermal properties. For example, a plastic e.g. PVC frame has insufficient strength for certain personnel door frame and garage door frame applications. A wood frame has sufficient strength but wicks water and is subject to rot and other types of deterioration. Aluminum, for example 6063-tg aluminum, has tensile strength of about 30,000 psi, but has unacceptable thermal conductivity of 1200 btu/ft$^2$/hr/° F./inch thickness. In addition, aluminum can be corroded and pitted when exposed to weather conditions for extended periods of time and can be dented and/or part of a paint coating can be scratched off.

By contrast, pultruded fiberglass-reinforced thermoset polyester has a longitudinal modulus of about 65,000 psi and a transverse modulus of about 10,000 psi. Thermal conductivity is 4.5 btu/ft$^2$/hr/° F./inch thickness.

Frame structures of the invention are sturdy and durable, and have favorable strength and rigidity, and favorable expansion and contraction ratings compared to the alternative materials they replace. The pultruded frame structures tolerate a wide range of temperatures such as are encountered in constructed buildings. The pultruded frame structures are not susceptible to water damage. Such frame structures are less susceptible to corroding under weather conditions to which they are exposed. They exhibit desired thermal properties. Frame kits of the invention are easily transported to the construction site. The frame kits and frames can be mass-produced and do not have to be project-specific, but custom sizes can easily be made.

Any given pultrusion can have a range of thicknesses of the respective walls of its profile. Such range of thicknesses can be related to the expedients of the pultrusion die, specific strength parameters desired for a certain portion of the profile, wall intersections, and the like. However, most pultruded structures used in jambs and door frames of the invention have a generally consistent nominal profile thickness over most of the pultruded structure. The general thickness "T" (FIG. 16) of a wall of the pultrusion also varies according to the specific use which will be made of the specific pultrusion. For example, a pultrusion which is to be used with a substrate 44 as in FIGS. 2 and 3 receives structural reinforcement from the substrate, whereby the stiffness and rigidity of the pultrusion need not be as robust as the stiffness and rigidity required of a pultrusion which is not so supported, for example the closed-perimeter jamb structures illustrated in FIGS. 12-13 and 15-19.

Accordingly, for a jamb where the pultrusion is supported by a substrate, the pultrusion can be relatively thinner, having a nominal thickness "T" of e.g. 0.050 inch to 0.075 inch, more commonly 0.060 inch to 0.065 inch, with a target thickness of about 0.062 inch. Where stiffness and rigidity of the pultrusion is not reinforced by a substrate, nominal thickness "T" of the pultrusion is typically about 0.075 inch to about 0.100 inch, more commonly 0.080 inch to 0.095 inch, with a target thickness of about 0.090 inch. The here-recited thicknesses apply to common-size residential door frames. For example, such garage door frames are typically 7 feet wide to 8 feet wide for a single garage door, and 15-18 feet wide for a double garage door. Exterior entry e.g. personnel doors on a building are typically 36 inches wide to 42 inches wide. Double doors are sometimes used, whereby the entry door frame is even wider.

Although the invention has been described with respect to various embodiments, it should be realized this invention is also capable of a wide variety of further and other embodiments within the spirit and scope of the appended claims.

Those skilled in the art will now see that certain modifications can be made to the apparatus and methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

To the extent the following claims use means plus function language, it is not meant to include there, or in the instant specification, anything not structurally equivalent to what is shown in the embodiments disclosed in the specification.

Having thus described the invention, what is claimed is:

1. A door jamb, adapted to be coupled to second and third door jambs to make a door frame assembly, said door jamb having a front, a rear, a door-facing side and an opposing building-facing side, a length, and a depth between the front and the rear, said door jamb comprising:

(a) an elongate jamb block (229) extending along the length of said door jamb and comprising a front wall (240), a rear wall (242), a first side wall (224) on the door-facing side of said jamb, and a second side wall (226) on the building-facing side of said jamb, said jamb block further comprising first and second mounting structures, spaced from each other, in the vicinity of said rear wall; and (b) an elongate depth extender extending along the length of said door jamb, said depth extender comprising a finger strip locked in said first mounting structure and a locking stud strip locked in said second mounting structure.

2. A door jamb as in claim 1, said first and second mounting structures being disposed on respective said first and second side walls of said jamb block.

3. A door jamb as in claim 1, said first and second mounting structures, and said finger strip and said locking stud strip, collectively, being positioned, adapted, and configured such that said finger strip can be registered with said first mounting structure and said jamb extender subsequently rotated about said finger strip to bring said locking stud strip into locking engagement with said second mounting structure, thereby locking said jamb extender to said jamb block at said first and second mounting structures.

4. A door jamb as in claim 3, said depth extender comprising a second rear wall, and third and fourth side walls extending frontwardly from said second rear wall, said second rear wall and said third and fourth side walls, collectively defining a depth extender cavity therebetween, said third side wall terminating in said finger strip with said finger strip extending inwardly toward the cavity, and said fourth side wall terminating in said locking stud strip.

5. A door jamb, said door jamb having a front, a rear, a door-facing side and an opposing building-facing side, a length, and a depth between the front and the rear, said door jamb comprising (a) an elongate jamb block (229) extending along the length of said door jamb, said jamb block comprising a first rear wall (240), a second front wall (242), a first side wall (224) on the door-facing side of said jamb, and a second side wall (226) on the building-facing side of said jamb, said front and rear walls, and said side walls, collectively defining a iamb internal cavity, said jamb block further comprising first and second mounting structures, said first and second mounting structures being disposed in the vicinity of one of said first and second end walls, being spaced from each other, and being disposed on respective said first and second side walls and (b) an elongate depth extender mounted to said iamb block, said depth extender extending along the length of said door iamb, and comprising a finger strip locked in said first mounting structure and a locking stud strip locked in said second mounting structure.

6. A door jamb as in claim 5, further comprising a weather seal mounted in said first mounting structure.

7. A door iamb as in claim 5, one of said first and second mounting structures in said iamb block comprising an undercut cavity extending, from a respective one of said first and second side walls inwardly toward but spaced from the iamb internal cavity, and through an opening having first and second opening side walls, and thence toward said rear end wall, said depth extender further comprising a corner recess on an inner surface of said first side wall adjacent said first mounting structure, said corner recess interconnecting with a said opening side wall when said depth extender is so-mounted to said iamb block.

8. A door jamb as in claim 5, said first and second mounting structures being disposed on respective said first and second side walls of said jamb block.

9. A door jamb, adapted to be coupled to second and third door jambs to make a door frame assembly, and wherein such door frame assembly is adapted to be attached to building structure members at a doorway rough opening in an exterior wall of a building, said jamb having a front, a rear, a door-facing side and an opposing building-facing side, a length, a depth between the front and the rear, and a thickness between the door-facing side and the building-facing side, said jamb comprising:

(a) an elongate jamb block (229) extending along the length of said door jamb and comprising a front wall (240), a dosed rear wall (242), a first side wall (224) on a door-facing side of said jamb, and a second side wall (226) on a building-facing side of said jamb, said first and second side walls extending from the front of said jamb block to said rear wall, said front wall, said rear wall, and said side walls defining a rear cavity (230); and said elongate jamb block defining a generally closed perimeter at the rear of said jamb block, said jamb block further comprising a mounting cavity (246) in the vicinity of said rear wall, further comprising a lock receptor in the vicinity of said rear wall and spaced from the mounting cavity (246), and (b) an elongate depth extender, said depth extender having a profile extending along the length of said door jamb, and being mounted to said jamb block, said depth extender comprising a rear wall (258), a third side wall (260) on the door-facing side of said jamb, a fourth side wall on the building-facing side of said jamb, said third and fourth side walls extending from the rear of said depth extender to the front of said depth extender, said third side wall (260) terminating in a mounting finger strip (265) locked in a said mounting cavity on said jamb block and said fourth side wall (262) terminating in a locking stud strip (266) locked in said lock receptor (249) on said jamb block, whereby said depth extender is locked to said jamb block, at the rear of said jamb block, by said mounting finger strip and said locking stud.

10. A door jamb as in claim 9, one of said first and second mounting structures in said jamb block comprising an undercut cavity extending from a respective one of said first and second side walls inwardly toward, but spaced from, the rear cavity (230) and toward said dosed rear wall (242) and under the respective one of said first and second side walls.

11. A door jamb as in claim 10, said depth extender further comprising a sixth mounting structure on said fourth side wall, in the vicinity of said second rear wall of said depth extender.

12. A door jamb as in claim 9, said depth extender having a second rear wall and third and fourth side walls, and further comprising, as a fifth mounting structure, a second mounting cavity on said third side wall and in the vicinity of said second rear wall of said depth extender.

13. An elongate depth extender adapted to be mounted on a jamb block thereby to extend a depth of a door jamb, said depth extender having a front end and a rear end, a door-facing side and a building-facing side, and comprising:

(a) an end wall;

(b) a first side wall extending between said end wall and the front of said depth extender, on the door-facing side of said depth extender; and (c) a second side wall extending between said end wall and the opposing end of said depth extender, on the building-facing side of said depth extender, said first and second side walls, and said end wall, collectively defining a cavity therebetween, said first side wall terminating in a first mounting structure extending inwardly toward the cavity, and said second side wall terminating in a second mounting structure, spaced from said first mounting structure, said first and second mounting structures extending, as extensions of the respective said side walls, inwardly toward the cavity.

14. An elongate depth extender as in claim 13, said first mounting structure extending, from such inwardly-disposed locus, toward the front end of said depth extender and away from said end wall.

15. An elongate depth extender as in claim 13, further comprising a mounting cavity on said first side wall, spaced from said first mounting structure.

16. An elongate depth extender as in claim 15, further comprising a lock receptor on said second side wall and in the vicinity of said end wall, and spaced from said second mounting structure.

17. A building in-swing door frame assembly, comprising a first door jamb, coupled to second and third door jambs to make said door frame assembly, said door frame assembly having a front, a rear, a door-facing side and an opposing building-facing side, a length, and a depth between the front and the rear, said first door jamb comprising:

(a) an elongate jamb block (229) having a profile extending along the length of said first door jamb and comprising a first end wall (240), a second end closed rear wall (242), a first side wall (224) on the door-facing side of said first door jamb, and a second side wall (226) on the building-facing side of said first door jamb, said first and second side walls extending between the first end of said jamb block and said second end wall, said first end wall, said second end wall, and said side walls defining an internal cavity (230), further comprising a door abutment surface on said first side wall of said first door jamb and spaced from said first end wall (240), said elongate jamb block further comprising a strip receiving cavity in said first wall and a lock receptor (249) in the vicinity of said rear wall, spaced from said strip-receiving cavity; and (b) an elongate depth extender, said depth extender extending along the length of said iamb block, and being mounted to said iamb block, said depth extender comprising a third end wall, a third side wall (260) on the door-facing side of said jamb, and a fourth side wall on the building facing side of said iamb, said third side wall (260) terminating in a mounting finger strip (265) locked in an undercut portion of said strip-receiving cavity in said first side wall of said iamb block, and said fourth side wall terminating in a locking stud (266) locked in said lock receptor (249) on said iamb block.

18. An in-swing door frame as in claim 17, said strip receiving cavity extending, from said first side wall, toward but spaced from the internal cavity, through an opening having first and second side walls, and thence toward said rear wall (242).

19. An in-swing door frame as in claim 17, said depth extender further comprising a fifth mounting structure on said third side wall and in the vicinity of said third end wall of said depth extender.

20. An in-swing door frame as in claim 19, further comprising a sixth mounting structure on said fourth side wall and in the vicinity of said third end wall and spaced from said fifth mounting structure.

21. An in-swing door frame as in claim 19, said fifth mounting structure comprising a second mounting cavity and further comprising a weather seal mounted in the second mounting cavity.

22. An in-swing door frame as in claim 19, further comprising an inner portion (276) of at least one of said third side wall (260) and said third end wall in stressed engagement with at least one of said first side wall (224) and said first end wall of said jamb block adjacent said first end wall (242) of said jamb block.

23. A door jamb as in claim 17, said strip receiving cavity and said lock receptor being disposed on respective said first and second side walls of said jamb block.

* * * * *